US011634908B1

(12) United States Patent
Parkes et al.

(10) Patent No.: US 11,634,908 B1
(45) Date of Patent: Apr. 25, 2023

(54) FUNCTIONALLY REINFORCED CONCRETE SLAB

(71) Applicant: Illinois Tool Works Inc., Glenview, IL (US)

(72) Inventors: Nigel Parkes, Roswell, GA (US); Robert Rodden, Atlanta, GA (US); Feng Mu, Houston, TX (US)

(73) Assignee: Illinois Tool Works Inc., Glenview, IL (US)

( * ) Notice: Subject to any disclaimer, the term of this patent is extended or adjusted under 35 U.S.C. 154(b) by 0 days.

(21) Appl. No.: 17/198,422

(22) Filed: Mar. 11, 2021

Related U.S. Application Data

(60) Provisional application No. 62/992,245, filed on Mar. 20, 2020.

(51) Int. Cl.
*E04C 5/04* (2006.01)
*E04B 5/32* (2006.01)
*E04C 5/07* (2006.01)

(52) U.S. Cl.
CPC ..... *E04C 5/04* (2013.01); *E04B 5/32* (2013.01); *E04C 5/073* (2013.01); *E04B 2103/02* (2013.01)

(58) Field of Classification Search
CPC ..... E04B 5/32; E04B 2103/02; E04C 5/04; E04C 5/06; E04C 5/16; E04C 5/073
See application file for complete search history.

(56) References Cited

U.S. PATENT DOCUMENTS 388,449 A * 8/1888 Searles ..... E04C 5/04 52/660
459,014 A * 9/1891 Miles ..... E04C 5/04 52/660
1,388,544 A * 8/1921 Benedict ..... E04C 5/04 404/70
1,986,172 A * 1/1935 Wilson ..... E04C 5/0636 52/690
2,094,853 A 10/1937 Shaw
2,196,158 A * 4/1940 Allbright ..... E04B 5/32 249/32
4,469,465 A 9/1984 Andrus
4,733,519 A 3/1988 Schrader et al.
4,901,498 A * 2/1990 Gerwick, Jr. ..... E04C 5/16 52/649.1
5,392,580 A 2/1995 Baumann
(Continued)

FOREIGN PATENT DOCUMENTS

AT 12894 U2 * 1/2013
CN 108442594 A * 8/2018 ..... E04B 5/02
(Continued)

*Primary Examiner* — Jessie T Fonseca
(74) *Attorney, Agent, or Firm* — Neal, Gerber & Eisenberg LLP

(57) ABSTRACT

Various embodiments provide a functionally reinforced concrete slab including a concrete substrate having a first substrate area with a first reinforcement level and a second substrate area having a different second reinforcement level. The functionally reinforced concrete slab further includes a concrete substrate reinforcement apparatus enclosed within the concrete substrate. The concrete substrate reinforcement apparatus is positioned based on the first substrate area and the second substrate area to provide a non-uniform reinforcement of the concrete substrate.

12 Claims, 14 Drawing Sheets

(56) References Cited

U.S. PATENT DOCUMENTS 5,491,941 A * 2/1996 Lancelot, III ..... E04C 5/163 52/223.14
5,651,635 A 7/1997 Nagle
6,503,434 B1 1/2003 Mayer
6,612,085 B2 9/2003 Edwards et al.
7,926,181 B2 4/2011 Li et al.
8,511,038 B2 8/2013 Brandstrom
8,627,626 B2 1/2014 Boxall et al.
9,540,815 B2 1/2017 Iihoshi et al.
2005/0055949 A1* 3/2005 Sacks ..... E04C 5/04 52/633
2005/0055953 A1* 3/2005 Sacks ..... E04C 5/0627 52/633
2005/0072115 A1* 4/2005 Chappell ..... E02D 27/32 52/782.1
2008/0172974 A1* 7/2008 Suarez ..... E04C 5/04 52/685
2011/0064517 A1 3/2011 Sader
2011/0219721 A1* 9/2011 Densmore ..... E04C 5/168 52/687
2012/0210656 A1* 8/2012 Martin Hernandez ... E04B 5/48 52/125.1
2012/0272600 A1* 11/2012 Ytterberg ..... E04C 5/04 52/414
2015/0329424 A1 11/2015 Pinkerton et al.
2018/0059060 A1 3/2018 Dusseault et al.
2020/0232219 A1 7/2020 Lamm et al.

FOREIGN PATENT DOCUMENTS

CN 109972790 A * 7/2019
DE 4123595 A1 * 1/1993 ..... E04B 5/43
EP 1650371 A1 * 4/2006 ..... E04B 1/161
EP 2063042 A1 * 5/2009 ..... E04C 5/04
JP 2019189998 A * 10/2019
JP 2019206812 A * 12/2019
KR 20120074387 A * 7/2012

* cited by examiner

FUNCTIONALLY REINFORCED CONCRETE SLAB

PRIORITY CLAIM

This application claims priority to and the benefit of U.S. Provisional Patent Application Ser. No. 62/992,245, filed Mar. 20, 2020, the entire contents of which is incorporated herein by reference.

BACKGROUND

Concrete floors and concrete roads typically include a plurality of adjacent concrete slabs that are individually cast-in-place or formed from larger concrete slabs that are cast-in-place and formed with one or more contraction joints and that eventually separate. Contraction joints (which are also sometimes called control joints) are used to control naturally or randomly occurring cracking in concrete floors from stresses caused by concrete shrinkage, thermal contraction, moisture or thermal gradients within the concrete, and/or various external forces on these concrete floors. It should be appreciated that the term concrete slab as used herein is meant to include a separately individually cast-in-place concrete slab or a concrete slab formed from a larger concrete slab.

Various known concrete slabs are uniformly reinforced (such as by steel rebar or macrosynthetic fibers). These reinforcements assist in ensuring that a concrete slab that has or develops one or more cracks (that can result in undesired separation of a concrete slab into multiple sections) maintains its functionality and such that these sections are maintained in relatively close adjacent positions relative to one another. The reinforcements in these various known concrete slabs ensure that one section of the concrete slab (defined by the crack) is capable of dragging the other section of the concrete slab (which could be as much as the weight of half of the concrete slab) to avoid substantial separation of the sections of the concrete slab. These concrete slabs include a uniform amount of reinforcement throughout the concrete slab including the corner areas of the concrete slabs.

There is a continuing need to reduce the cost and the amount of materials used in concrete substrates, and to provide an improved reinforced concrete slabs.

SUMMARY

Various embodiments of the present disclosure provide a functionally reinforced concrete slab having a non-uniform concrete substrate reinforcement apparatus that addresses the above issues. Various embodiments of the present disclosure provide a non-uniform concrete substrate reinforcement apparatus for a concrete slab that also addresses the above issues. Various embodiments of the present disclosure provide methods of forming a functionally reinforced concrete slab having a non-uniform reinforcement apparatus that addresses the above issues.

In various embodiments, the present disclosure provides a functionally reinforced concrete slab including a concrete substrate having a plurality of substrate areas that have different levels of reinforcement. The functionally reinforced concrete slab includes a concrete substrate reinforcement apparatus within the concrete substrate and that is configured and positioned based on the desired levels of reinforcement for each of the respective different substrate areas of the concrete slab.

In various example embodiments, the concrete slab includes a first substrate area with a first reinforcement level and a plurality of second substrate areas each having a second reinforcement level different than the first reinforcement level. The functionally reinforced concrete slab includes a concrete substrate reinforcement apparatus within the concrete substrate that is configured and positioned based on the first substrate area and the second substrate areas to provide the non-uniform reinforced substrate areas of the concrete slab.

In various other example embodiments, the concrete slab includes a first substrate area with a first reinforcement level, a plurality of second substrate areas each having a second reinforcement level different than the first reinforcement level, and a plurality of third substrate areas each having a third reinforcement level different than the first reinforcement level and different than the second reinforcement level. The functionally reinforced concrete slab includes a concrete substrate reinforcement apparatus within the concrete substrate that is configured and positioned based on the first substrate area, the second substrate areas, and the third substrate areas to provide the non-uniform reinforced substrate areas of the concrete slab.

Other objects, features, and advantages of the present disclosure will be apparent from the following detailed disclosure, taken in conjunction with the accompanying sheets of drawings, wherein like reference numerals refer to like parts.

DETAILED DESCRIPTION

Figure 1:
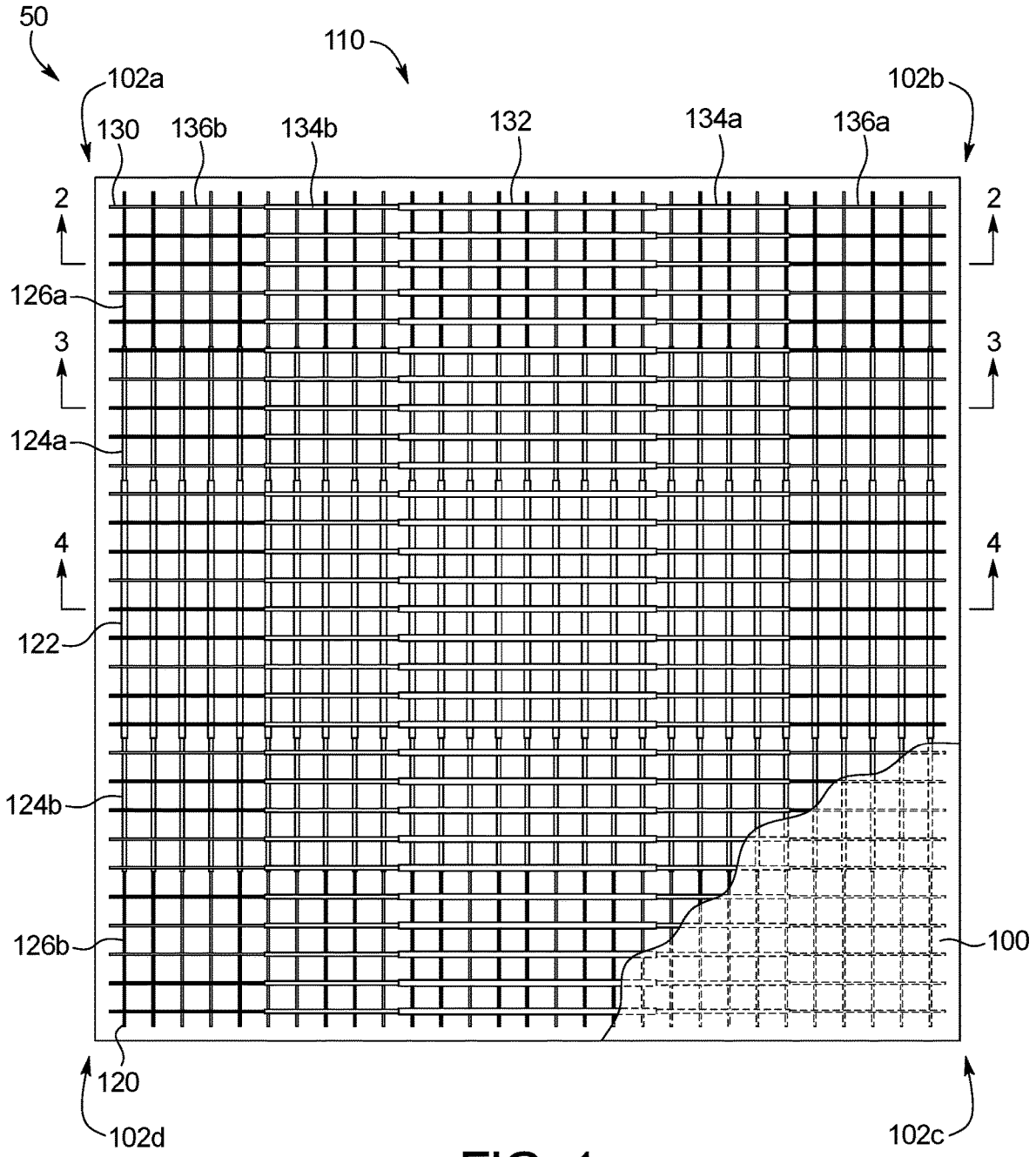
FIG. 1 is a fragmentary top view of one example embodiment of a functionally reinforced concrete slab of the present disclosure showing longitudinally extending reinforcing dowels having different diameters extending through the concrete slab to partially provide the non-uniform reinforcement of the concrete slab, and showing transversely extending reinforcing dowels having different diameters extending through the concrete slab to partially provide the non-uniform reinforcement of the concrete slab.

While the features, devices, and apparatus described herein may be embodied in various forms, the drawings show and the specification describes certain exemplary and non-limiting embodiments. Not all of the components shown in the drawings and described in the specification may be required, and certain implementations may include additional, different, or fewer components. Variations in the arrangement and type of components; the shapes, sizes, and materials of the components; and the manners of connections of the components may be made without departing from the spirit or scope of the claims. Unless otherwise indicated, any directions referred to in the specification reflect the orientations of the components shown in the corresponding drawings and do not limit the scope of the present disclosure. Further, terms that refer to assembly methods, such as mounted, attached, connected, and the like, are not intended to be limited to direct assembly methods but should be interpreted broadly to include indirect and operably mounted, attached, connected and like assembly methods. This specification is intended to be taken as a whole and interpreted in accordance with the principles of the present disclosure and as understood by one of ordinary skill in the art.

Various embodiments of the present disclosure provide a functionally reinforced concrete slab having a concrete substrate with non-uniform reinforcement levels. These non-uniform reinforcement levels provide the concrete substrate with different reinforcement amounts in different areas of the substrate and thus different areas of the concrete slab. Certain areas of the concrete substrate have greater reinforcement levels or amounts, while certain other areas of the concrete substrate have lesser reinforcement levels or amounts.

For example, in accordance with the present disclosure, a central area of the concrete substrate that is a first distance from one of the substrate free-edges of the concrete slab will have a greater level or amount of reinforcement than in a corner section of the substrate that is a shorter distance from the substrate-free-edge of the concrete slab. This is in part because if a crack develops near the central area of the concrete slab, the concrete slab may need to drag a greater amount of the concrete slab. On the other hand, if a crack develops in a corner section of the concrete slab, the concrete slab may need to only drag a lessor amount of the concrete slab.

In other words, generally, the reinforcement amount needed to drag a smaller amount or section of the concrete slab is less than the reinforcement amount needed to drag a greater amount or section of the concrete slab. Thus, the present disclosure provides non-uniform reinforcement levels that enable configuration of the functionally reinforced concrete slab to have lower reinforcement amounts where less reinforcement is needed and greater reinforcement amounts where greater reinforcement is needed.

Various embodiments of the present disclosure provide a non-uniform concrete substrate reinforcement apparatus for a concrete substrate in various different manners. For example, the concrete substrate reinforcement apparatus may provide different reinforcement amounts by using one or more dowels having different diameters along the span of the dowel. In another example, the concrete reinforcement apparatus may provide different reinforcement amounts by using one or more dowels having different lengths. In another example, the concrete reinforcement apparatus may provide different reinforcement amounts by using one or more dowels along with different amounts of reinforcement fibers disposed in with the concrete substrate of the concrete slab. In various example embodiments, the concrete slab includes a first substrate area with a first reinforcement level and a plurality of second substrate area each having a different second reinforcement level. In various other example embodiments, the concrete slab includes a first substrate area with a first reinforcement level, a plurality of second substrate area each having a different second reinforcement level, and a plurality of third substrate areas each having a different third reinforcement level. These various different concrete substrate reinforcement apparatus are configured to provide greater reinforcement amounts in areas of the concrete substrate having higher reinforcement level requirements, and less reinforcement amounts in areas of the concrete substrate having lower reinforcement level requirements. Various embodiments of the present disclosure also provide a method of forming a functionally reinforced concrete slab including a concrete substrate having a non-uniform reinforcement apparatus.

Example Functionally Reinforced Concrete Slab

Referring now to the Figures, FIGS. 1, 1A, 2, 3, and 4 illustrate one example embodiment of a functionally reinforced concrete slab of the present disclosure that is generally indicated by numeral 50 (and sometimes referred to herein as "the concrete slab" for brevity). This example illustrated functionally reinforced concrete slab 50 includes: (1) a concrete substrate 100 suitably supportable on the ground or other supporting surface; and (2) a concrete substrate reinforcement apparatus 110 positioned within and supported by the concrete substrate 100.

In this illustrated example embodiment, the concrete substrate 100 has a generally square shape including a plurality of substrate free-edges 102*a*, 102*b*, 102*c*, and 102*d* defined at the corners and/or along the perimeter of the concrete slab 50. It will be appreciated that the concrete substrate 100 may have a different shape and the plurality of substrate free-edges may be defined along the corners and/or edges of that different shape.

In this illustrated example embodiment, the concrete substrate reinforcement apparatus 110 has a plurality of reinforcement areas R1, R2*a*, R2*b*, R2*c*, R2*d*, R3*a*, R3*b*, R3*c*, R3*d*, R4*a*, R4*b*, R4*c*, R4*d*, R5*a*, R5*b*, R5*c*, R5*d*, R5*e*, R5*f*, R5*g*, R5*h*, R6*a*, R6*b*, R6*c* and R6*a* in the concrete slab 50.

Reinforcement area R1 provides a first reinforcement level for the concrete slab 50. Reinforcement areas R2*a*, R2*b*, R2*c*, and R2*d* are substantially similar to each other and provide a second reinforcement level for the concrete slab 50. Reinforcement areas R3*a*, R3*b*, R3*c*, and R3*d* are substantially similar to each other and provide a third reinforcement level for the concrete slab 50. Reinforcement areas R4*a*, R4*b*, R4*c*, and R4*d* are substantially similar to each other and provide a fourth reinforcement level for the concrete slab 50. Reinforcement areas R5*a*, R5*b*, R5*c*, R5*d*, R5*e*, R5*f*, R5*g*, and R5*h* are substantially similar to each other and provide a fifth reinforcement level for the concrete slab 50. Reinforcement areas R6*a*, R6*b*, R6*c*, and R6*d* are substantially similar to each other and provide a sixth reinforcement level for the concrete slab 50.

In this illustrated example embodiment, reinforcement levels of the concrete slab 50 have the following relationship: first reinforcement level>second reinforcement level>third reinforcement level>fourth reinforcement level>fifth reinforcement level. As such, the reinforcement levels of the concrete slab 50 are greater in interior areas of the concrete slab 50 and the reinforcement levels of the concrete slab 50 are less in exterior areas of the concrete slab 50. In this illustrated example embodiment, the reinforcement levels of the concrete slab 50 are greater in a central area of the concrete slab 50 and the reinforcement levels of the concrete slab 50 are less in outer areas surrounding the central area of the concrete slab 50.

Thus, in this illustrated example embodiment, the concrete slab 50 has a plurality of different substrate areas that have different reinforcement levels corresponding to the respective reinforcement levels R1, R2*a*, R2*b*, R2*c*, R2*d*, R3*a*, R3*b*, R3*c*, R3*d*, R4*a*, R4*b*, R4*c*, R4*d*, R5*a*, R5*b*, R5*c*, R5*d*, R5*e*, R5*f*, R5*g*, R5*h*, R6*a*, R6*b*, R6*c* and R6*a* of the concrete substrate reinforcement apparatus 110.

In this illustrated example embodiment, the different reinforcement levels of the concrete slab 50 are configured to keep cracks tight during shifting, settling, expansion, contraction, and/or other such movement of the concrete slab 50. In this illustrated example, the desired reinforcement levels are based on the amount of reinforcement needed to keep cracks tight. As such, certain areas of the concrete slab 50 have different desired reinforcement levels (e.g., greater or lesser) than certain other areas of the concrete slab 50.

In this illustrated example embodiment, the concrete reinforcement apparatus 110 includes: (1) a plurality of longitudinally extending dowels 120 supported within the concrete substrate 100 and extending along a length of the concrete substrate 100; and (2) a plurality of transversely extending dowels 130 supported within the concrete substrate 100 and extending along a width of the concrete substrate 100.

In this illustrated example, the longitudinally and transversely extending dowels 120 and 130 of the concrete reinforcement apparatus 110 are formed from steel rods. However, it should be appreciated that the dowels can be made from other suitable materials in accordance with the present disclosure.

In this illustrated example embodiment, each longitudinally extending dowel 120 of the concrete reinforcement apparatus 110 includes: (1) a first longitudinal dowel portion 122 having a first diameter; (2) a second longitudinal dowel portion 124*a* suitably connected to and extending from one end of the first longitudinal dowel portion 122, the second longitudinal dowel portion 124*a* having a second diameter different from the first diameter of the first longitudinal dowel portion 122; (3) a third longitudinal dowel portion 124*b* suitably connected to and extending from the other end of the first longitudinal dowel portion 122, the third longitudinal dowel portion 124*b* having a third diameter different from the first diameter of the first longitudinal dowel portion 122, and the third diameter of the third longitudinal dowel portion 124*b* being substantially similar to the second diameter of the second longitudinal dowel portion 124*a*; (4) a fourth longitudinal dowel portion 126*a* suitably connected to and extending from one end of the second longitudinal dowel portion 124*a*, the fourth longitudinal dowel portion 126*a* having a fourth diameter different from the first, second, and third diameters of the first, second, and third longitudinal dowel portions 122, 124*a*, and 124*b*; and (5) a fifth longitudinal dowel portion 126*b* suitably connected to and extending from one end of the third longitudinal dowel portion 124*b*, the fifth longitudinal dowel portion 126*b* having a fifth diameter different from the first, second, and third diameters of the first, second, and third longitudinal dowel portions 122, 124*a*, and 124*b*, and the fifth diameter of the fifth longitudinal dowel portion 126*b* being substantially similar to the fourth diameter of the fourth longitudinal dowel portion 126*a*.

In this illustrated example embodiment: (a) the first longitudinal dowel portions 122 are configured with the largest diameter dimensions; (b) the second and third longitudinal dowel portions 124*a* and 124*b* are configured with intermediate diameter dimensions that are smaller than the first longitudinal dowel portions 122; and (c) the fourth and fifth longitudinal dowel portions 126*a* and 126*b* are configured with the smallest diameter dimensions that are smaller than the first longitudinal dowel portions 122, and the second and third longitudinal dowel portions 124*a* and 124*b*. As such, the diameter of each longitudinally extending dowel 120 decreases from the dowel center (e.g., first longitudinal portion 122) to the dowel ends (e.g., fourth and fifth longitudinal portions 126*a* and 126*b*).

In this illustrated example embodiment, each transversely extending dowel 130 of the concrete reinforcement apparatus 110 includes: (1) a first transverse dowel portion 132 having a first diameter; (2) a second transverse dowel portion 134*a* suitably connected to and extending from one end of the first transverse dowel portion 132, the second transverse dowel portion 134*a* having a second diameter different from the first diameter of the first transverse dowel portion 132; (3) a third transverse dowel portion 134*b* suitably connected to and extending from the other end of the first transverse dowel portion 132, the third transverse dowel portion 134*b* having a third diameter different from the first diameter of the first transverse dowel portion 132, and the third diameter of the third transverse dowel portion 134*b* being substantially similar to the second diameter of the second transverse dowel portion 134*a*; (4) a fourth transverse dowel portion 136*a* suitably connected to and extending from one end of the second transverse dowel portion 134*a*, the fourth transverse dowel portion 136*a* having a fourth diameter different from the first, second, and third diameters of the first, second, and third transverse dowel portions 132, 134*a*, and 134*b*; and (5) a fifth transverse dowel portion 136*b* suitably connected to and extending from one end of the third transverse dowel portion 134*b*, the fifth transverse dowel portion 136*b* having a fifth diameter different from the first, second, and third diameters of the first, second, and third transverse dowel portions 132, 134*a*, and 134*b*, and the fifth diameter of the fifth transverse dowel portion 136*b* being substantially similar to the fourth diameter of the fourth transverse dowel portion 136*a*.

In this illustrated example embodiment: (a) the first transverse dowel portions 132 are configured with the largest diameter dimensions; (b) the second and third transverse dowel portions 134*a* and 134*b* are configured with intermediate diameter dimensions that are smaller than the first transverse dowel portions 132; and (c) the fourth and fifth transverse dowel portions 136*a* and 136*b* are configured with the smallest diameter dimensions that are smaller than the first transverse dowel portions 132 and the second and third transverse dowel portions 134*a* and 134*b*. As such, the diameter of each transversely extending dowel 130 decreases from the dowel center (e.g., first transverse portion 132) to the dowel ends (e.g., fourth and fifth transverse portions 136*a* and 136*b*).

Thus, in this illustrated example embodiment, dowels in reinforcement area R1 provide a greater reinforcement level of the concrete slab 50 than the dowels in reinforcement areas R2*a*, R2*b*, R2*c*, and R2*d*. Dowels in reinforcement areas R2*a*, R2*b*, R2*c*, and R2*d* provide a greater reinforcement level of the concrete slab 50 than the dowels in reinforcement areas R3*a*, R3*b*, R3*c*, and R3*d*. Dowels in reinforcement areas R3*a*, R3*b*, R3*c*, and R3*d* provide a greater reinforcement level of the concrete slab 50 than the dowels in reinforcement areas R4*a*, R4*b*, R4*c*, and R4*d*. Dowels in reinforcement areas R4*a*, R4*b*, R4*c*, and R4*d* provide a greater reinforcement level of the concrete slab 50 than the dowels in reinforcement areas R5*a*, R5*b*, R5*c*, R5*d*, R5*e*, R5*f*, R5*g* and R5*h*. Dowels in reinforcement area R5*a*, R5*b*, R5*c*, R5*d*, R5*e*, R5*f*, R5*g* and R5*h* provide a greater reinforcement level of the concrete slab 50 than the dowels in reinforcement areas R6*a*, R6*b*, R6*c*, and R6*d*.

In this illustrated example embodiment, the concrete substrate reinforcement apparatus 110 is configured to provide non-uniform reinforcement of the concrete slab 50. For example, reinforcement areas of the concrete slab 50 having greater desired reinforcement levels include portions of longitudinally and transversely extending dowels 120 and 130 having larger diameters, while reinforcement areas of the concrete slab 50 having less desired reinforcement levels include portions of longitudinally and transversely extending dowels 120 and 130 having smaller diameters.

In this illustrated example embodiment, the plurality of longitudinally and transversely extending dowels 120 and 130 are orientated within the concrete substrate 100 to provide an overlapping grid pattern of the concrete reinforcement apparatus 110. For example, the plurality of transversely extending dowels 130 are positioned in a repeating or arrayed pattern such that adjacent transversely extending dowels 130 are spaced apart from one another along the width of the concrete substrate 100. The plurality of longitudinally extending dowels 120 are orientated perpendicular to the plurality of transversely extending dowels 130. The plurality of longitudinally extending dowels 120 are positioned in a repeating or arrayed pattern such that adjacent longitudinally extending dowels 120 are spaced apart from one another along the length of the concrete substrate 100.

In this illustrated example embodiment, the longitudinally extending dowels 120 are placed on top of and suitably connected to the plurality of transversely extending dowels 130 to form the overlapping grid pattern of the concrete reinforcement apparatus 110.

In this illustrated example embodiment, the longitudinally extending dowels 120 are fabricated by suitably connecting the first, second, third, fourth, and fifth longitudinal dowel portions 122, 124*a*, 124*b*, 126*a*, and 126*b* such that the longitudinally extending dowels 120 extend along at least a portion of the length of the concrete slab 50. Similarly, the transversely extending dowels 130 are fabricated by suitably connecting the first, second, third, fourth, and fifth transverse dowel portions 132, 134*a*, 134*b*, 136*a* and 136*b* such that the transversely extending dowels 130 extend at least a portion of the width of the concrete slab 50.

It should be appreciated that, while the longitudinally and transversely extending dowels 120 and 130 are each shown to include five dowel portions, other suitable numbers of longitudinal and transverse dowel portions may also be employed in accordance with the present disclosure. In certain such alternative embodiments, the longitudinally and transversely extending dowels include fewer longitudinal and transverse dowel portions. In certain other such alternative embodiments, the longitudinally and transversely extending dowels include additional longitudinal and transverse dowel portions.

Figure 5:
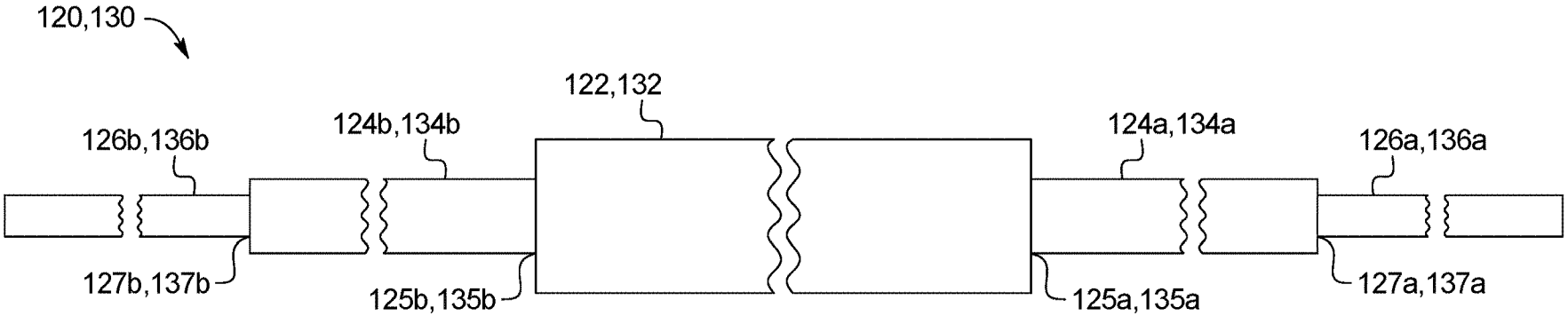
FIG. 5 is an enlarged diagrammatic fragmentary side view of an example longitudinally extending dowel or an example transversely extending dowel of the functionally reinforced concrete slab of FIG. 1.

As best seen in FIG. 5, in one illustrated example embodiment, the longitudinally extending dowels 120 are fabricated by: (a) suitably connecting the second longitudinal dowel portion 124*a* to one end of the first longitudinal dowel portion 122; (b) suitably connecting the third longitudinal dowel portion 124*b* to the other end of the first longitudinal dowel portion 122; (c) suitably connecting the fourth longitudinal dowel portion 126*a* to one end of the second longitudinal dowel portion 124*a*; and (d) suitably connecting the fifth longitudinal dowel portion 126*b* to one end of the third longitudinal dowel portion 124*b*. In this illustrated example, connection joints 125*a* and 125*b* between the first, second, and third longitudinal dowel portions 122, 124*a* and 124*b*, and connection joints 127*a* and 127*b* between the second, third, fourth, and fifth longitudinal dowel portions 124*a*, 124*b*, 126*a*, and 126*b* define substantially right angles. As such, the longitudinally extending dowel 120 includes a stepped profile between the dowel portions based on the different diameter dimensions of the first, second, third, fourth, and fifth longitudinal dowel portions 122, 124*a*, 124*b*, 126*a*, and 126*b*.

In this illustrated example embodiment, the transversely extending dowels 130 are similarly fabricated as the longitudinally extending dowels 120. The transversely extending dowels 130 are fabricated by: (a) suitably connecting the second transverse dowel portion 134*a* to one end of the first transverse dowel portion 132; (b) suitably connecting the third transverse dowel portion 134*b* to the other end of the first transverse dowel portion 132; (c) suitably connecting the fourth transverse dowel portion 136*a* to one end of the second transverse dowel portion 134*a*; and (d) suitably connecting the fifth transverse dowel portion 136*b* to one end of the third transverse dowel portion 134*b*. In this illustrated example, connection joints 135*a* and 135*b* between the first, second, and third transverse dowel portions 132, 134*a* and 134*b*, and connection joints 137*a* and 137*b* between the second, third, fourth, and fifth longitudinal dowel portions 134*a*, 134*b*, 136*a*, and 136*b* define substantially right angles. As such, the transversely extending dowel 130 includes a stepped profile between the dowel portions based on the different diameter dimensions of the first, second, third, fourth, and fifth transverse dowel portions 132, 134*a*, 134*b*, 136*a*, and 136*b*.

Figure 6:
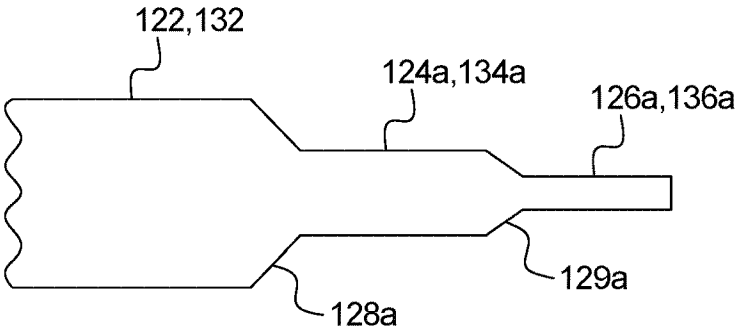
FIG. 6 is an enlarged diagrammatic fragmentary side view of another example embodiment of the longitudinally or the transversely extending dowel of FIG. 5

As best seen in FIG. 6, in another illustrated example embodiment, the longitudinally extending dowels 120 are fabricated with filleted connection joints 128*a* and 129*a* between the first, second, and fourth longitudinal dowel portions 122, 124*a*, and 126*a*. As such, the longitudinally extending dowel 120 includes a sloped profile between the dowel portions based on the different diameter dimensions of the first, second, and fourth longitudinal dowel portions 122, 124*a*, and 126*a*. Although not illustrated, It will be appreciated that similar filleted connection joints may be used to suitably connect the first, third, and fifth longitudinal dowel portions 122, 124*b*, and 126*b*.

In this illustrated example embodiment, the transversely extending dowels 130 are similarly fabricated as the longitudinally extending dowels 120. The transversely extending dowels 130 include filleted connection joints 138*a* and 139*a* between the first, second, and fourth transverse dowel portions 132, 134*a*, and 136*a*. As such, the transversely extending dowel 130 includes a sloped profile between the dowel portions based on the different diameter dimensions of the first, second, and fourth transverse dowel portions 132, 134*a*, and 136*a*. Although not illustrated, It will be appreciated that similar filleted connection joints may be used to suitably connect the first, third, and fifth transverse dowel portions 132, 134*b*, and 136*b*.

In this illustrated example embodiment, the decreasing diameter of each longitudinally and transversely extending dowel 120 and 130 provides non-uniform reinforcement levels within the functionally reinforced concrete slab 50. For example, the larger diameter dimensions at the middle of a span of the longitudinally and transversely extending dowels 120 and 130 provide a greater percent steel by concrete area in the middle of a span along the concrete slab 50, while the smaller diameter dimensions at the ends of a span of the longitudinally and transversely extending dowels 120 and 130 provide a significant reduction in the percent steel by concrete area at the perimeter of the concrete slab 50 that is adjacent to the substrate free-edges 102*a*, 102*b*, 102*c*, and 102*d* (e.g., corners and edges of concrete substrate 100).

In this illustrated example embodiment, the longitudinally and transversely extending dowels 120 and 130 include substantially similar dimensions (e.g., length, diameter, and other such dimensions). It should be appreciated that in other alternative embodiments the longitudinally and transversely extending dowels may have different dimensions from one another.

Figure 1A:
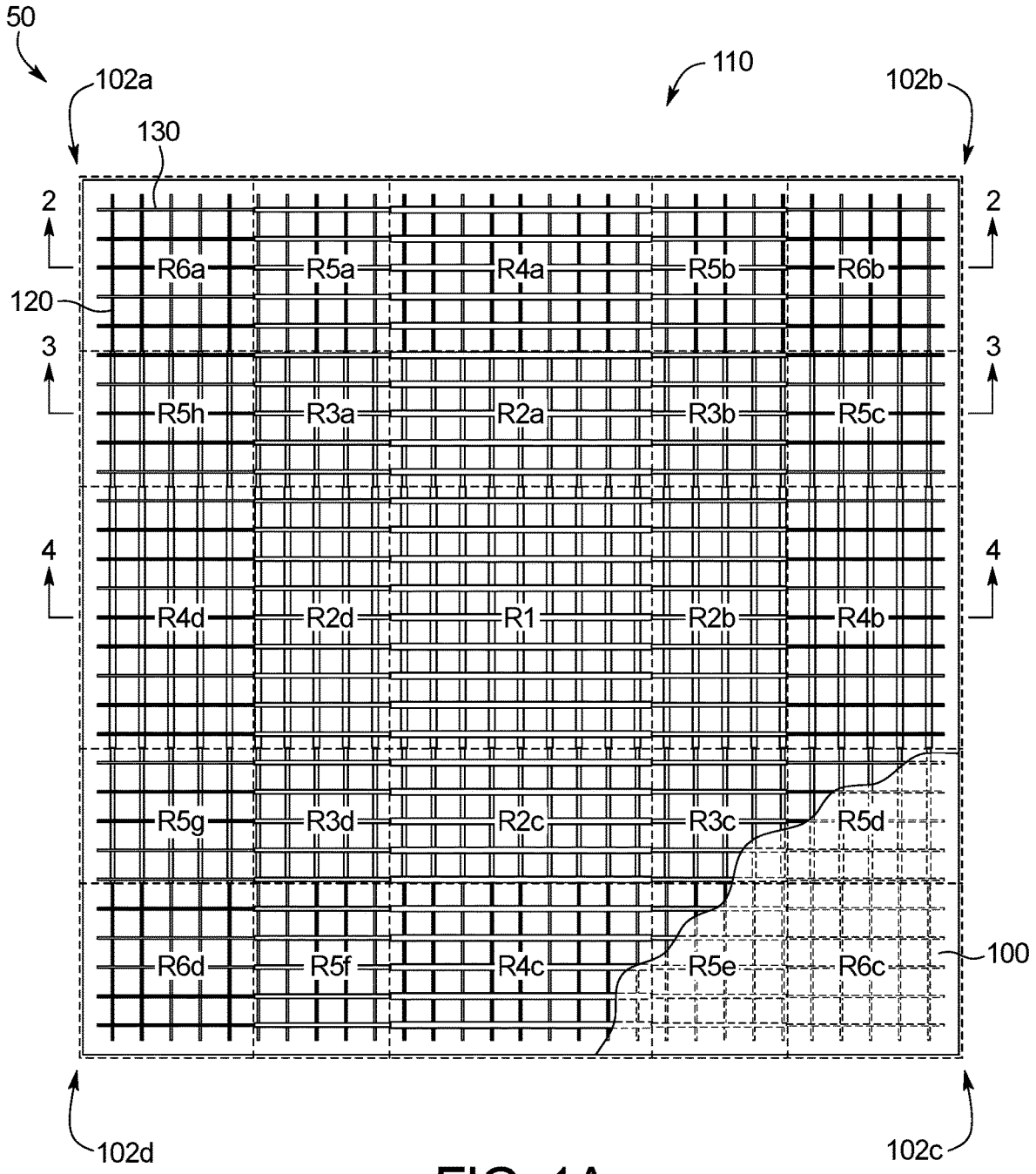
FIG. 1A is a top view of the functionally reinforced concrete slab of FIG. 1, showing the labeled different reinforcing areas of the concrete slab.
Figure 2:
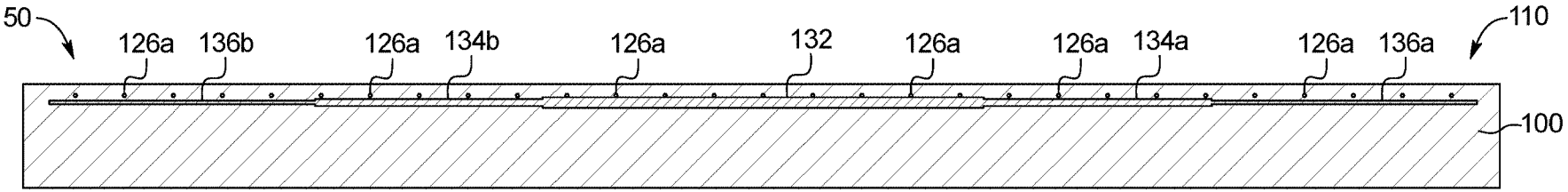
FIG. 2 is an enlarged transverse cross-sectional view taken substantially along line 2-2 of the reinforced concrete slab of FIG. 1, showing longitudinally extending reinforcing dowels having a first diameter, and showing a transversely extending reinforcing dowel having a first diameter, a second different diameter, and a third different diameter.

FIGS. 1, 1A, and 2, show a transverse cross-sectional view of the concrete substrate reinforcement apparatus 110 taken substantially along line 2-2 and through different reinforcement areas of the concrete slab 50. In this illustrated example, the concrete substrate reinforcement apparatus 110 includes the first transverse dowel portion 132 of the longitudinally extending dowel 130 extending through reinforcement area R4*a* of the concrete slab 50, the second transverse dowel portion 134*a* of the transversely extending dowel 130 extending through reinforcement area R5*b* of the concrete slab 50, the third transverse dowel portion 134*b* of the transversely extending dowel 130 extending through reinforcement area R5*a* of the concrete slab 50, the fourth transverse dowel portion 136*a* of the transversely extending dowel 130 extending through reinforcement area R6*b* of the concrete slab 50, and the fifth transverse dowel portion 136*b* of the transversely extending dowel 130 extending through reinforcement area R6*a* of the concrete slab 50. In this illustrated example, the first transverse dowel portion 132 in reinforcement area R4*a* has a larger diameter than the second and third transverse dowel portions 134*a* and 134*b* in reinforcement areas R5*a* and R5*b*. The second and third transverse dowel portions 134*a* and 134*b* in reinforcement areas R5*a* and R5*b* have larger diameters than the fourth and fifth transverse dowel portions 136*a* and 136*b* in reinforcement areas R6*a* and R6*b*.

In this illustrated example embodiment, the concrete substrate reinforcement apparatus 110 further includes a plurality of fourth longitudinal dowel portions 126*a* of the longitudinally extending dowels 120 extending through reinforcement area R4*a* of the concrete slab 50, a plurality of fourth longitudinal dowel portions 126*a* of the longitudinally extending dowels 120 extending through reinforcement area R5*b* of the concrete slab 50, a plurality of fourth longitudinal dowel portions 126*a* of the longitudinally extending dowels 120 extending through reinforcement area R5*a* of the concrete slab 50, a plurality of fourth longitudinal dowel portions 126*a* of the longitudinally extending dowels 120 extending through reinforcement area R6*b* of the concrete slab 50, and a plurality of fourth longitudinal dowel portions 126*a* of the longitudinally extending dowels 120 extending through reinforcement area R6*a* of the concrete slab 50.

Figure 3:
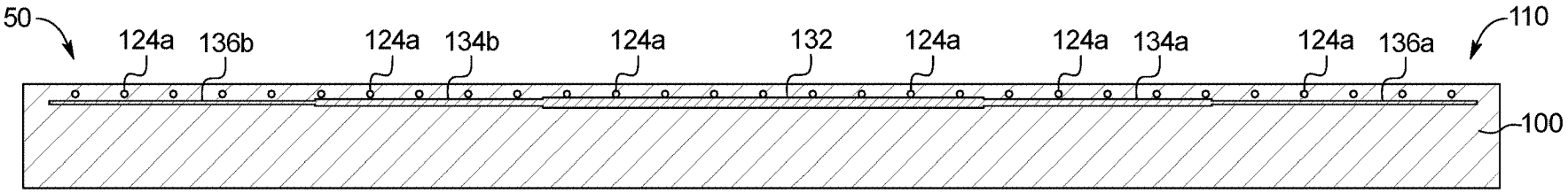
FIG. 3 is an enlarged transverse cross-sectional view taken substantially along line 3-3 of the reinforced concrete slab of FIG. 1, showing longitudinally extending reinforcing dowels having a diameter, and showing a transversely extending reinforcing dowel having a first diameter, a second different diameter, and a third different diameter.

FIGS. 1, 1A and 3, show a transverse cross-sectional view of the concrete substrate reinforcement apparatus 110 taken substantially along line 3-3 and through different reinforcement areas of the concrete slab 50. In this illustrated example, the concrete substrate reinforcement apparatus 110 includes the first transverse dowel portion 132 of the transversely extending dowel 130 extending through reinforcement area R2*a* of the concrete slab 50, the second transverse dowel portion 134*a* of the transversely extending dowel 130 extending through reinforcement area R3*b* of the concrete slab 50, the third transverse dowel portion 134*b* of the transversely extending dowel 130 extending through reinforcement area R3*a* of the concrete slab 50, the fourth transverse dowel portion 136*a* of the transversely extending dowel 130 extending through reinforcement area R5*c* of the concrete slab 50, and the fifth transverse dowel portion 136*b* of the transversely extending dowel 130 extending through reinforcement area R5*h* of the concrete slab 50.

In this illustrated example embodiment, the concrete substrate reinforcement apparatus 110 further includes a plurality of second longitudinal dowel portions 124*a* of the longitudinally extending dowels 120 extending through reinforcement area R2*a* of the concrete slab 50, a plurality of second longitudinal dowel portions 124*a* of the longitudinal extending dowels 120 extending through reinforcement area R3*b* of the concrete slab 50, a plurality of second longitudinal dowel portions 124*a* of the longitudinal extending dowels 120 extending through reinforcement area R3*a* of the concrete slab 50, a plurality of second longitudinal dowel portions 124*a* of the longitudinal dowels 120 extending through reinforcement area R5*c* of the concrete slab 50, and a plurality of second longitudinal dowel portions 124*a* of the longitudinal extending dowels 120 extending through reinforcement area R5*h* concrete slab 50.

Figure 4:
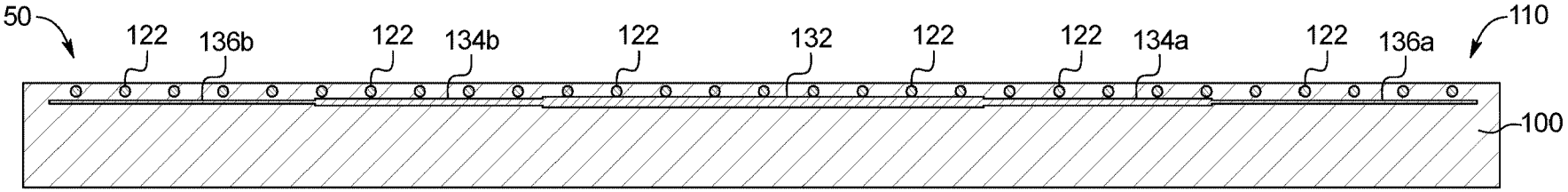
FIG. 4 is an enlarged transverse cross-sectional view taken substantially along line 4-4 of the reinforced concrete slab of FIG. 1, showing longitudinally extending reinforcing dowels having a diameter, and showing a transversely extending reinforcing dowel having a first diameter, a second different diameter, and a third different diameter.

FIGS. 1, 1A and 4, show a transverse cross-sectional view of the concrete substrate reinforcement apparatus 110 taken substantially along line 4-4 and through different reinforcement areas of the concrete slab 50. In this illustrated example, the concrete substrate reinforcement apparatus 110 includes the first transverse dowel portion 132 of the transversely extending dowel 130 extending through reinforcement area R1 of the concrete slab 50, the second transverse dowel portion 134*a* of the transversely extending dowel 130 extending through reinforcement area R2*b* of the concrete slab 50, the third transverse dowel portion 134*b* of the transversely extending dowel 130 extending through reinforcement area R2*d* of the concrete slab 50, the fourth transverse dowel portion 136*a* of the transversely extending dowel 130 extending through reinforcement area R4*b* of the concrete slab 50, and the fifth transverse dowel portion 136*b* of the transversely extending dowel 130 extending through reinforcement area R4*d* of the concrete slab 50.

In this illustrated example embodiment, the concrete substrate reinforcement apparatus 110 further includes a plurality of first longitudinal dowel portions 122 of the longitudinally extending dowels 120 extending through reinforcement area R1 of the concrete slab 50, a plurality of first longitudinal dowel portions 122 of the longitudinal extending dowels 120 extending through reinforcement area R2*b* through the concrete slab 50, a plurality of first longitudinal dowel portions 122 of the longitudinal extending dowels 120 extending through reinforcement area R2*d* of the concrete slab 50, a plurality of first longitudinal dowel portions 122 of the longitudinal dowels 120 extending through reinforcement area R4*b* of the concrete slab 50, and a plurality of first longitudinal dowel portions 122 of the longitudinal extending dowels 120 extending through reinforcement area R4*d* of the concrete slab 50.

Figure 7:
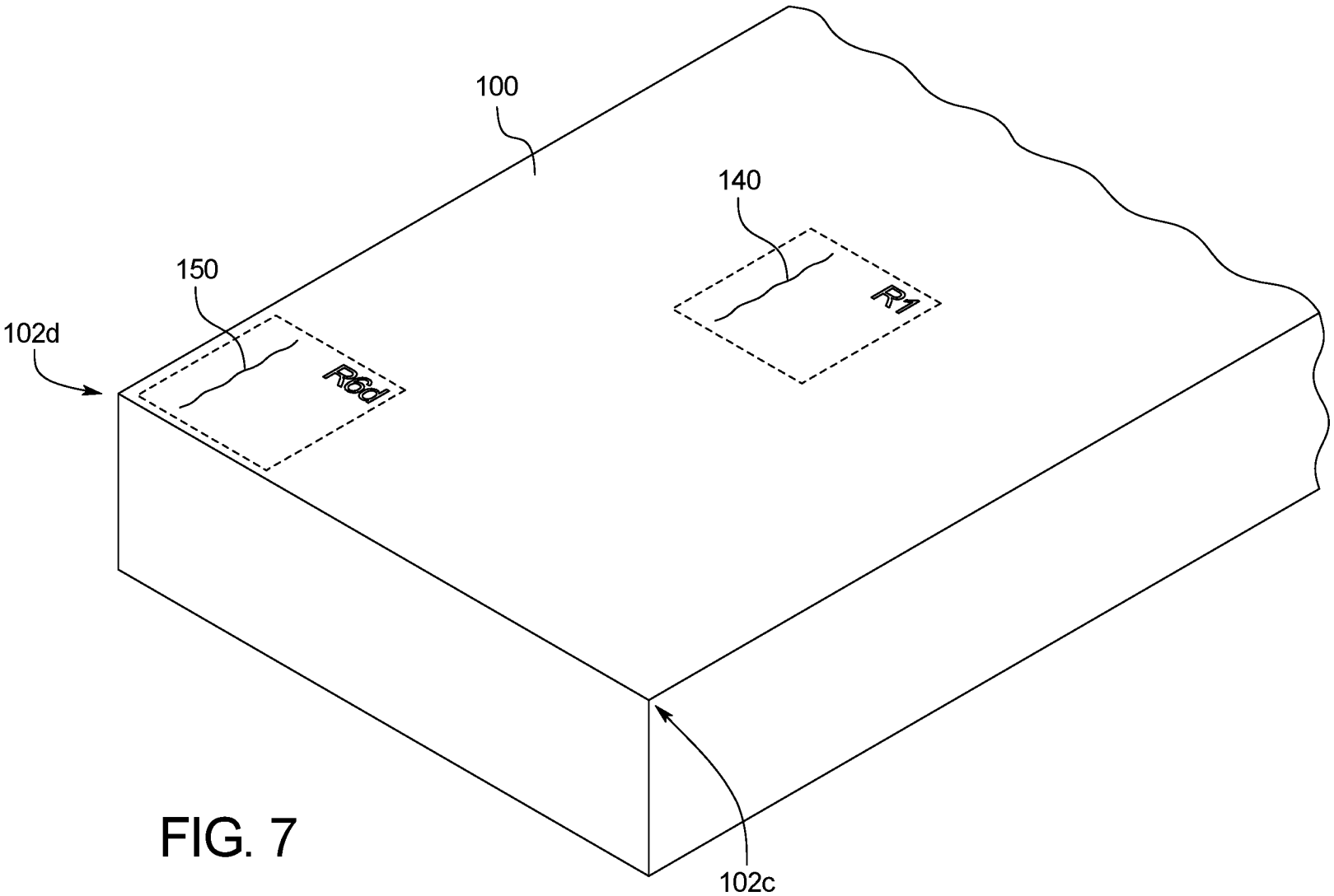
FIG. 7 is a fragmentary top perspective view of the functionally reinforced concrete slab of FIG. 1, showing part of a first crack in the concrete substrate, and showing part of a second different crack in the concrete substrate.

FIG. 7 shows the example functionally reinforced concrete slab 50 including part of a first crack 140 and part of a second crack 150. In this illustrated example embodiment, the first crack 140 is near the middle of a span along the concrete slab 50. The first crack 140 is associated with reinforcement area R1 of the concrete slab 50. In this illustrated example, the second crack is 150 is near the perimeter of the concrete slab 50 adjacent to the substrate free-edge 102*d*. The second crack 150 is associated with reinforcement area R6*d* of the concrete slab 50.

As shown in FIGS. 1 and 1A, the reinforcement areas R1 and R6*d* of the concrete slab 50 are associated with desired reinforcement levels provided by the concrete substrate reinforcement apparatus 110. The concrete substrate reinforcement apparatus 110 is configured to provide certain reinforcement levels that keep the first and second cracks 140 and 150 tight during shifting, settling, expansion, contraction, and/or other such movement of the concrete substrate 100. More specifically, the desired reinforcement levels associated with reinforcement areas R1 and R6*d* of the concrete slab 50 at least in part determine the configuration of the concrete substrate reinforcement apparatus 110.

In the illustrated example shown in FIG. 7, the desired reinforcement levels are based on the distance from the first and second cracks 140 and 150 to the substrate free-edge 102*d*. The reinforcement levels are used to configure the concrete substrate reinforcement apparatus 110 in order to keep the first and second cracks 140 and 150 tight during movement of the concrete substrate 100. For example, the first crack 140 is approximately in the middle of a span across the concrete slab 50 and the furthest distance from the substrate free-edge 102*d*. While the second crack 150 is at the perimeter of the concrete slab 50 and adjacent to the substrate free-edge 102*d*. As such, to keep the first crack 140 tight, the concrete substrate reinforcement apparatus 110 is configured to provide greater amounts of reinforcement to reinforcement area R1. To keep the second crack tight 150, the concrete substrate reinforcement apparatus 110 is further configured to provide relatively lower amounts of reinforcement to reinforcement area R6*d*.

In this illustrated example, the concrete substrate reinforcement apparatus 110 is configured such that overlapping first longitudinal dowel portions 122 of longitudinally extending dowels 120 and first transverse dowel portions 132 of transversely extending dowels 130 are positioned in reinforcement area R1 of the concrete slab 50, while overlapping fifth longitudinal portions 126*b* of the longitudinally extending dowels 120 and fifth transverse dowel portions 136*b* of the transversely extending dowels 130 are positioned in reinforcement area R6*d* of the concrete slab 50. The first longitudinal and transverse dowel portions 122 and 132 in reinforcement area R1 provide a greater reinforcement level than the fifth longitudinal and transverse dowel portions 126*b* and 136*b* in reinforcement area R6*d*.

This example concrete substrate reinforcement apparatus 110 configuration provides a greater reinforcement level in reinforcement area R1 of the concrete slab 50 because the concrete substrate reinforcement apparatus 110 needs to drag a larger portion of the concrete substrate 110 (e.g., approximately half of the slab) to keep the first crack 140 tight. This example concrete substrate reinforcement apparatus 110 configuration provides a lesser reinforcement level in reinforcement area R6*d* of the concrete slab 50 because here the concrete substrate reinforcement apparatus 110 needs to drag a smaller portion of the concrete slab (e.g., substantially less than half of the slab) to keep the second crack 150 tight.

FIGS. 8, 8A, 9, and 10 illustrate another example embodiment of a functionally reinforced concrete slab of the present disclosure indicated by numeral 1050 (and sometimes referred to herein as "the concrete slab" for brevity). This example illustrated functionally reinforced concrete slab 1050 includes: (1) a concrete substrate 1100 suitably supported on the ground or other such supporting surface; and (2) a concrete substrate reinforcement apparatus 1110 supported within the concrete substrate 1100.

In this illustrated example embodiment, the concrete substrate 1100 has a generally square shape including a plurality of substrate free-edges 1102*a*, 1102*b*, 1102*c*, and 1102*d* defined at the corners and/or along the perimeter of the concrete slab 1050. It will be appreciated that the concrete substrate 1100 may have a different shape and the plurality of substrate free-edges may be defined along the corners and/or edges of that different shape.

In this illustrated example embodiment, the concrete substrate reinforcement apparatus 1110 has a plurality of reinforcement areas R1, R2*a*, R2*b*, R2*c*, and R2*d* in the concrete slab 1050.

Reinforcement area R1 provides a first reinforcement level for the concrete slab 1050. Reinforcement areas R2*a*, R2*b*, R2*c*, and R2*d* are substantially similar to each other and provide a second reinforcement level for the concrete slab 1050.

In this illustrated example embodiment, reinforcement levels of the concrete slab 1050 have the following relationship: first reinforcement level>second reinforcement level. As such, the reinforcement levels of the concrete slab 1050 are greater in an interior area of the concrete slab 50 and the reinforcement levels of the concrete slab 1050 are less in an exterior area of the concrete slab 1050. In this illustrated example embodiment, the reinforcement levels of the concrete slab 1050 are greater in a central area of the concrete slab 1050 and the reinforcement levels of the concrete slab 1050 are less in an outer area surrounding the central area of the concrete slab 1050.

Thus, in this illustrated example embodiment, the concrete slab 1050 has a plurality of different substrate areas that have different reinforcement levels corresponding to the respective reinforcement levels R1, R2*a*, R2*b*, R2*c*, and R2*d* of the concrete substrate reinforcement apparatus 1110.

In this illustrated example embodiment, the different the reinforcement levels of the concrete slab 1050 are configured to keep cracks tight during shifting, settling, expansion, contraction, and/or other such movement of the concrete slab 1050. In this illustrated example, the desired reinforcement levels are based on the amount of reinforcement needed to keep cracks tight. As such, certain areas of the concrete slab 1050 have different desired reinforcement levels (e.g., greater or lesser) than certain other areas of the concrete slab 1050.

In this illustrated example embodiment, the concrete reinforcement apparatus 1110 includes: (1) a plurality of longitudinally extending dowels 1120 supported within the concrete substrate 1100 and extending along a length of the concrete substrate 1100; and (2) a plurality of transversely extending dowels 1130 supported within the concrete substrate 1100 and extending along a width of the concrete substrate 1100.

In this illustrated example embodiment, the longitudinally and transversely extending dowels 1120 and 1130 of the concrete reinforcement apparatus 1110 are formed from steel rods. However, it should be appreciated that the dowels can be made from other suitable materials.

In this illustrated example embodiment, the longitudinally extending dowels 1120 of the concrete reinforcement apparatus 1100 include one of: (1) a first longitudinal dowel 1122 having a first length; or (2) a second longitudinal dowel 1124 having a second length different from the first length of the first longitudinal dowel 1122. The first length of each first longitudinal dowel 1122 is shorter than the second length of each second longitudinal dowel 1124. In this illustrated example, the first longitudinal dowels 1122 are configured to extend a portion of the concrete substrate 1100 length, while the second longitudinal dowels 1124 are configured to extend a longer portion of the concrete substrate 1100 length.

In this illustrated example embodiment, the transversely extending dowels 1130 of the concrete reinforcement apparatus 1100 include one of: (1) a first transverse dowel 1132 having a first length; or (2) a second transverse dowel 1134 having a second length different from the first length of the first transverse dowel 1132. The first length of the first transverse dowels 1132 is shorter than the second length of the second transverse dowels 1134. In this illustrated example, the first transverse dowels 1132 are configured to extend a portion of the concrete substrate 1100 width, while the second transverse dowels 1134 are configured to extend a longer portion of the concrete substrate 1100 width.

In this illustrated example embodiment, the first longitudinal dowels 1122 1120 have a diameter substantially the same as a diameter of the second longitudinal dowels 1124. Similarly, the first transverse dowels 1132 have a diameter substantially the same as a diameter of the second transverse dowels 1132.

In this illustrated example embodiment, the first longitudinal dowels 1122 of the longitudinally extending dowels 1120 have substantially the same length and diameter as the first transverse dowels 1132 of the transversely extending dowels 1130. The second longitudinal dowels 1124 of the longitudinally extending dowels 1120 have substantially the same length and diameter as the second transverse dowels 1134 of the transversely extending dowels 1130.

Thus, in this illustrated example embodiment, dowels in reinforcement area R1 provide a greater reinforcement level of the concrete slab 1050 than the unreinforced concrete in reinforcement areas R2*a*, R2*b*, R2*c*, and R2*d* of the concrete slab 1050.

In this illustrated example embodiment, the plurality of longitudinally and transversely extending dowels 1120 and 1130 are positioned and orientated within the concrete substrate 1100 to provide an overlapping grid pattern of the concrete reinforcement apparatus 1110. For example, the plurality of transversely extending dowels 1130 are positioned in a repeating or arrayed pattern such that adjacent transversely extending dowels 1130 are spaced apart from one another along the width of the concrete substrate 1100. The plurality of longitudinally extending dowels 1120 are orientated perpendicular to the plurality of transversely extending dowels 1130. The plurality of longitudinally extending dowels 1120 are positioned in a repeating or arrayed pattern such that adjacent longitudinally extending dowels 1120 are spaced apart from one another along the length of the concrete substrate 1100.

In this illustrated example embodiment, the longitudinally extending dowels 1120 are placed on top of and suitably connected to the plurality of transversely extending dowels 1130 to form the overlapping grid pattern of the concrete reinforcement apparatus 1110.

In this illustrated example embodiment, by employing different lengths of longitudinally and extending dowels 1120 and 1130, the overlapping grid pattern of the concrete reinforcement apparatus 1110 provides non-uniform reinforcement levels of the concrete slab 1050. For example, the shorter, first longitudinal and transverse dowels 1122 and 1132 are employed in areas of the concrete slab 1050 such that these dowels do not extend through portions of the concrete substrate 1100 adjacent to the substrate free-edges 1102*a*, 1102*b*, 1102*c*, and 1102*d*. While longer, second longitudinal and transverse dowels 1124 and 1134 are employed in areas of the concrete slab 1050 along a middle portion of a span between the substrate free-edges 1102*a*, 1102*b*, 1102*c*, 1102*d*. In other words, the concrete substrate reinforcement apparatus 1100 is configured to provide a greater reinforcement level in certain areas of the concrete slab 1050 (e.g., reinforcement area R1), and a lesser reinforcement level in certain other areas of the concrete slab 1050 (e.g., reinforcement areas R2*a*, R2*b*, R2*c*, and R2*d*).

In this illustrated example embodiment, reinforcement areas having greater amounts of desired reinforcement levels (e.g., reinforcement area R1) include the shorter, first longitudinal and transverse dowels 1122 and 1132, and the longer, second longitudinal and transverse dowels 1124 and 1134, while reinforcement areas having lower amounts of desired reinforcement levels (e.g., reinforcement areas R2*a*, R2*b*, R2*c*, and R2*d*) do not include either the shorter, first longitudinal and transverse dowels 1122 and 1132 or the longer, second longitudinal and transverse dowels 1124 and 1134. In other words, the concrete slab 1050 area associated with reinforcement area R1 includes reinforcement provided by the longitudinally and transversely extending dowels 1120 and 1130, while the concrete slab 1050 areas associated with reinforcement areas R2*a*, R2*b*, R2*c*, and R2*d* include reinforcement provided by unreinforced concrete.

Figure 8:
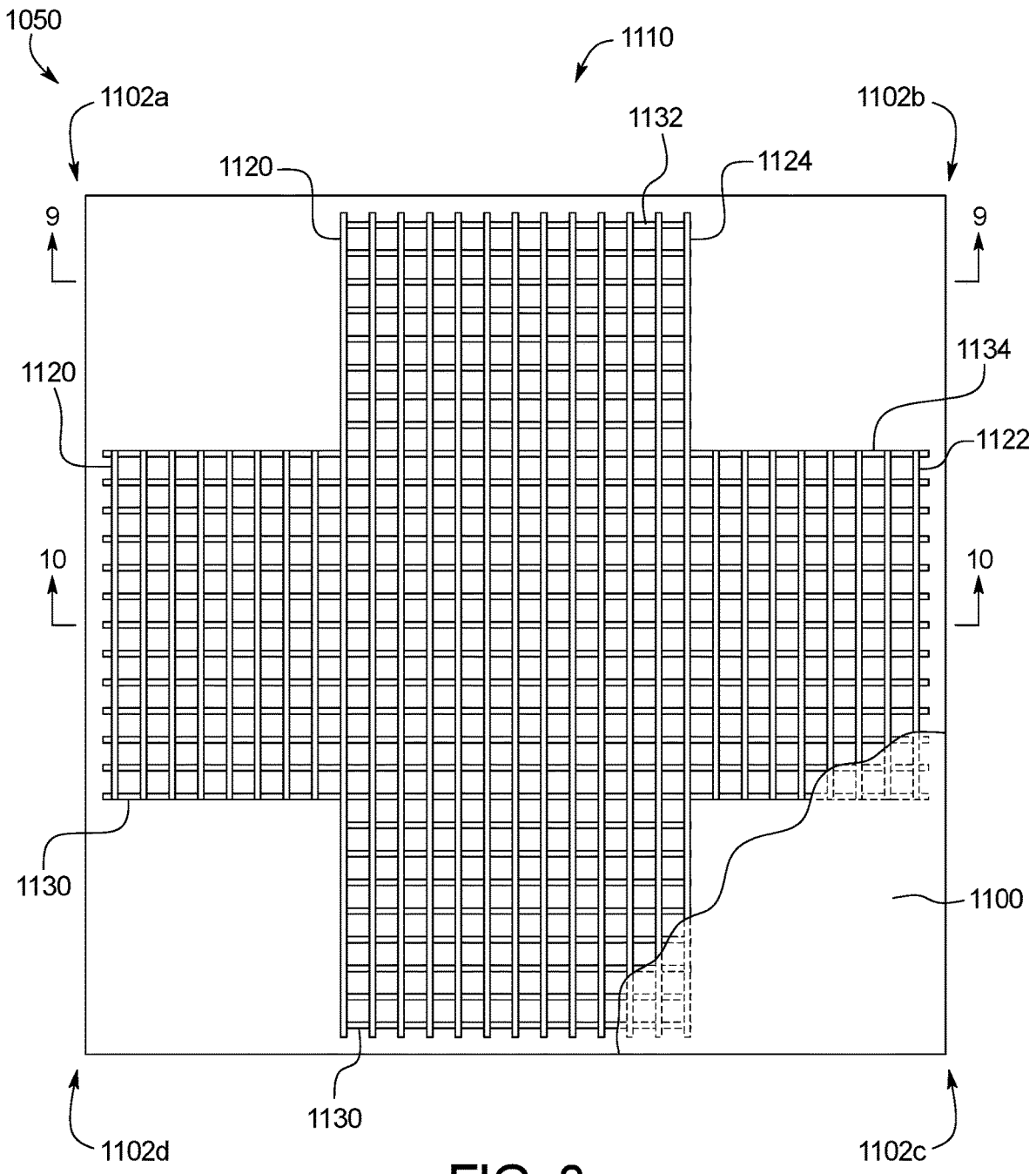
FIG. 8 is a fragmentary top view of another example embodiment of a functionally reinforced concrete slab of the present disclosure showing longitudinally extending reinforcing dowels having different lengths extending through the concrete slab, and showing transversely extending reinforcing dowels having different lengths extending through the concrete slab.
Figure 8A:
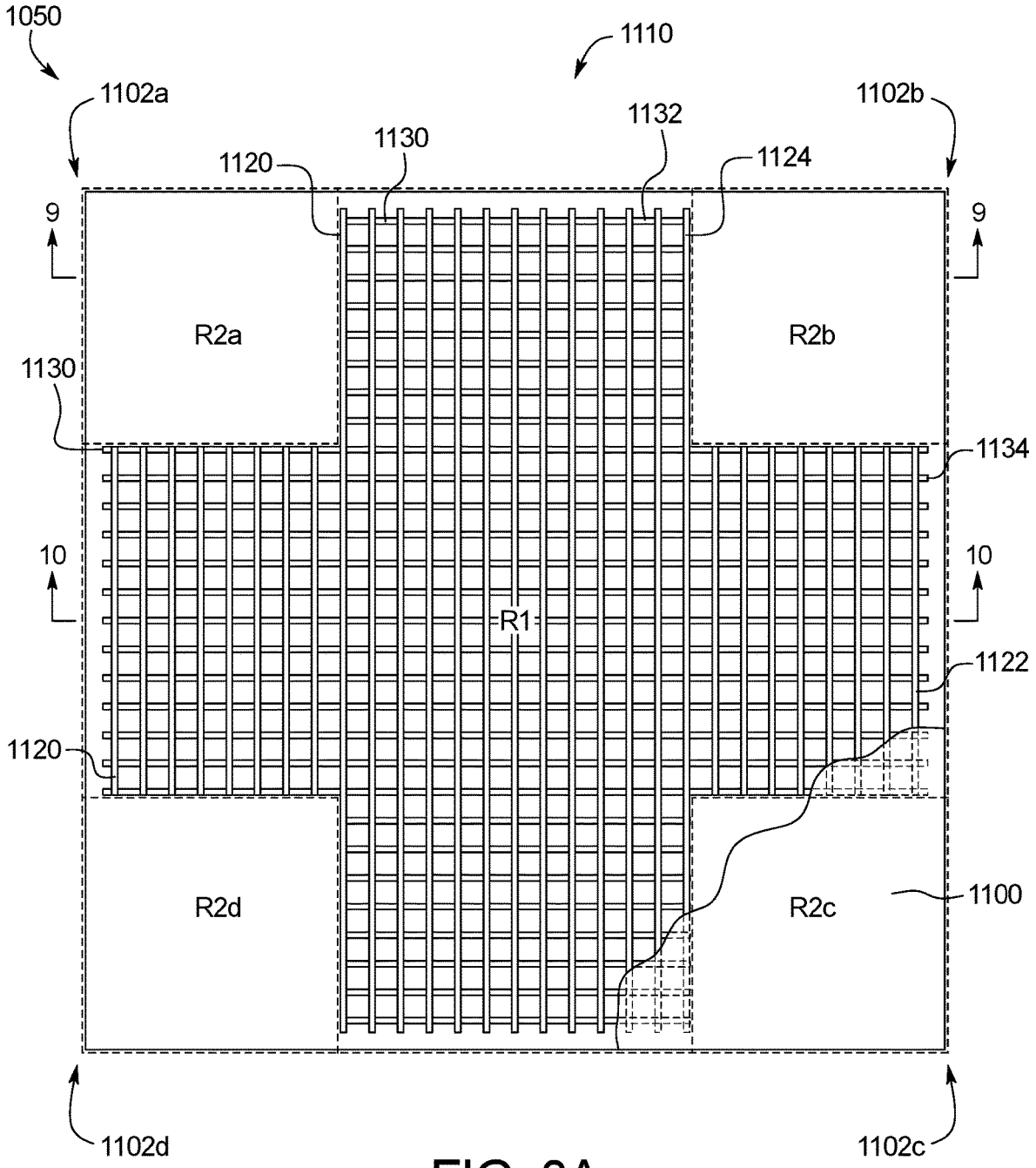
FIG. 8A is a fragmentary top view of the functionally reinforced concrete slab of FIG. 8, showing the labeled different reinforcing areas of the concrete slab.
Figure 9:
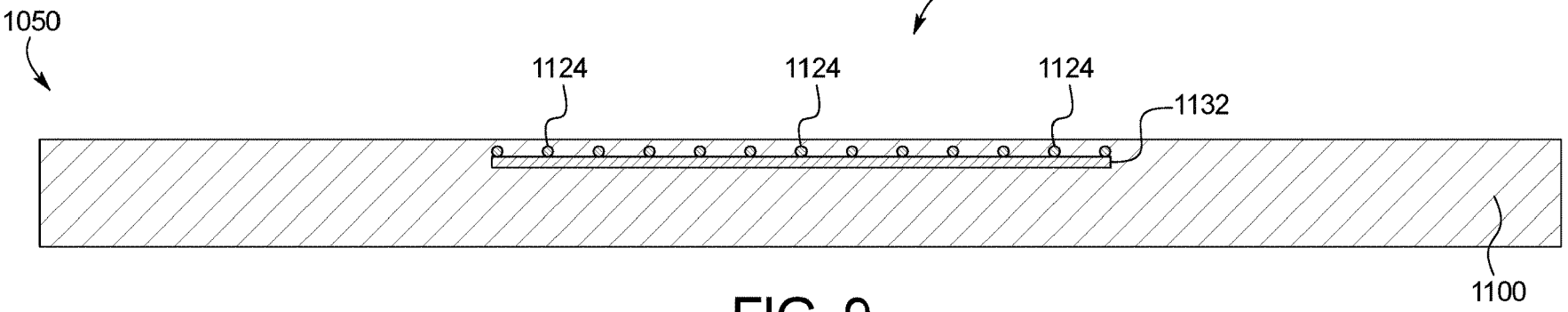
FIG. 9 is an enlarged transverse cross-sectional view taken substantially along line 9-9 of the reinforced concrete slab of FIG. 8, showing longitudinally and transversely extending reinforcing dowels having a first length extending through a portion of the concrete slab.

FIGS. 8, 8A, and 9 show a transverse cross-sectional view of the concrete substrate reinforcement apparatus 1110 taken substantially along line 9-9 and through different reinforcement areas of the concrete slab 1050. In this illustrated example embodiment, the concrete substrate reinforcement apparatus 1110 includes a first transverse dowel 1132 of the transversely extending dowels 1130 and a plurality of the second longitudinal dowels 1124 of the longitudinally extending dowels 1120 extending through reinforcement area R1 of the concrete slab 1050. The longitudinally and transversely extending dowels 1120 and 1130 extending through reinforcement area R1 of the concrete slab 1050 include the second longitudinal dowels 1124 having the longer length and the first transverse dowels 1132 having the shorter length. This shorter length of the first transverse dowels 1132 is configured such that the first transverse dowels 1132 do not extend through reinforcement areas R2*a* and R2*b* of the concrete slab 1050. Accordingly, the concrete substrate reinforcement apparatus 1110 is configured such that the second longitudinal dowels 1124 and the first transverse dowels 1132 extend through reinforcement area R1 of the concrete slab 1050 and do not extend through reinforcement areas R2*a* and R2*b* of the concrete slab 1050.

Figure 10:
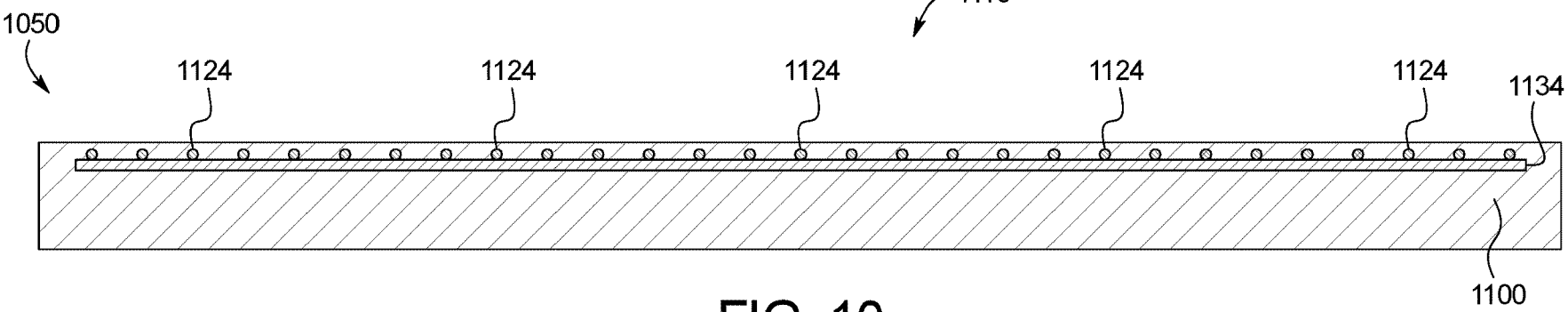
FIG. 10 is an enlarged transverse cross-sectional view taken substantially along line 10-10 of the reinforced concrete slab of FIG. 8, showing longitudinally and transversely extending reinforcing dowels having a second length extending through a portion of the concrete slab.

FIGS. 8, 8A, and 10 show a transverse cross-sectional view of the concrete substrate reinforcement apparatus 1110 taken substantially along line 10-10 and reinforcement area R1 of the concrete slab 1050. In this illustrated example embodiment, the concrete substrate reinforcement apparatus 1110 includes a second transverse dowel 1132 of the transversely extending dowels 1130 and a plurality of the first longitudinal dowels 1122 and second longitudinal dowels 1124 of the longitudinally extending dowels 1120 extending through reinforcement area R1 of the concrete slab 1050. Accordingly, the concrete substrate reinforcement apparatus 1110 is configured such that the first longitudinal and transverse dowels 1122 and 1132 and the second longitudinal and transverse dowels 1124 and 1134 extend through reinforcement area R1 of the concrete slab 1050.

FIGS. 11, 11A, 12, and 13 illustrate another example embodiment of a functionally reinforced concrete slab of the present disclosure indicated by numeral 2050 (and sometimes referred to herein as "the concrete slab" for brevity). This example illustrated functionally reinforced concrete slab 2050 includes: (1) a concrete substrate 2100; and (2) a concrete substrate reinforcement apparatus 2110 supported within the concrete substrate 2100.

In this illustrated example embodiment, the concrete substrate 2100 has a generally square shape including a plurality of substrate free-edges 2102*a*, 2102*b*, 2102*c*, and 2102*d* defined at the corners and/or along the perimeter of the concrete slab 2050. It will be appreciated that the concrete substrate 2100 may have a different shape and the plurality of substrate free-edges may be defined along the corners and/or edges of that different shape.

In this illustrated example embodiment, the concrete substrate reinforcement apparatus 2110 has a plurality of reinforcement areas R1, R2*a*, R2*b*, R2*c*, R2*d*, R3*a*, R3*b*, R3*c*, and R3*d* in the concrete slab 2050.

Reinforcement area R1 provides a first reinforcement level for the concrete slab 2050. Reinforcement areas R2*a*, R2*b*, R2*c*, and R2*d* are substantially similar to each other and provide a second reinforcement level for the concrete slab 2050. Reinforcement areas R3*a*, R3*b*, R3*c*, and R3*d* are substantially similar to each other and provide a third reinforcement level for the concrete slab 2050.

In this illustrated example embodiment, reinforcement levels of the concrete slab 2050 have the following relationship: first reinforcement level>second reinforcement level>third reinforcement level. As such the reinforcement levels of the concrete slab 2050 are greater in an interior area of the concrete slab 2050 and the reinforcement levels are less in an exterior area of the concrete slab 2050. In this illustrated example embodiment, the reinforcement levels of the concrete slab 2050 are greater in a central area of the concrete slab 2050 and the reinforcement levels of the concrete slab 2050 are less in an outer area surrounding the central area of the concrete slab 2050.

Thus, in this illustrated example embodiment, the concrete slab 2050 has a plurality of different substrate areas that have different reinforcement levels corresponding to the respective reinforcement levels R1, R2*a*, R2*b*, R2*c*, R2*d*, R3*a*, R3*b*, R3*c*, and R3*d* of the concrete substrate reinforcement apparatus 2110.

In this illustrated example embodiment, the different reinforcement levels of the concrete slab 2050 are configured to keep cracks tight during shifting, settling, expansion, contraction and/or other such movement of the concrete slab 2050. In this illustrated example, the desired reinforcement levels are based on the amount of reinforcement needed to keep the cracks tight. As such, certain areas of the concrete slab 2050 have different desired reinforcement levels (e.g., greater or lesser) than certain other areas of the concrete slab 2050.

In this illustrated example embodiment, the concrete reinforcement apparatus 2110 includes: (1) a plurality of longitudinally extending dowels 2120 supported within the concrete substrate 2100 extending along a length of the concrete substrate 2100; (2) a plurality of transversely extending dowels 2130 supported within the concrete substrate 2100 and extending along a width of the concrete substrate 2100; and (3) reinforcing fibers 2140 disposed in the concrete substrate 2100.

In this illustrated example embodiment, the longitudinally and transversely extending dowels 2120 and 2130 are formed from steel rods. However, it should be appreciated that the dowels can be made from other suitable materials.

In this illustrated example embodiment, the longitudinally extending dowels 2120 have substantially the same length and diameter as the transversely extending dowels 2130.

In this illustrated example embodiment, the plurality of longitudinally and transversely extending dowels 2120 and 2130 are positioned and orientated within the concrete substrate 2100 to provide a pattern of the concrete reinforcement apparatus 2110. For example, the plurality of transversely extending dowels 2130 are positioned in a repeating or arrayed pattern such that adjacent transversely extending dowels 2130 are spaced apart from one another along the width of the concrete substrate 2100. The plurality of longitudinally extending dowels 2120 are orientated perpendicular to the plurality of transversely extending dowels 2130. The plurality of longitudinally extending dowels 2120 are positioned in a repeating or arrayed pattern such that adjacent longitudinally extending dowels 2120 are spaced apart from one another along the length of the concrete substrate 2100.

In this illustrated example embodiment, certain of the longitudinally extending dowels 2120 are placed on top of and suitably connected to the plurality of transversely extending dowels 2130 to form an overlapping grid pattern including longitudinally extending dowels and transversely extending dowels 2130 of the concrete reinforcement apparatus 2110.

In this illustrated example embodiment, the concrete reinforcement apparatus 2110 includes reinforcing fibers 2140 disposed or otherwise mixed within the concrete slab 2050. The reinforcing fibers 2140 are distributed within the concrete slab 2050 such that the fibers are disposed within the substrate along the length and width of the concrete slab 2050. In this illustrated example, the reinforcing fibers 2140 are distributed in a substantially uniform amount within the concrete slab 2050. It will be appreciated that in other examples, different amounts of the reinforcing fibers 2140 may be used in different areas of the concrete slab 2050.

In one alternate example embodiment, reinforcement area R1 includes more reinforcing fibers 2140 than reinforcement areas R2*a*, R2*b*, R2*c*, and R2*d*. In this alternate example, reinforcement areas R2*a*, R2*b*, R2*c*, and R2*d* include more reinforcing fibers 2140 than reinforcement areas R3*a*, R3*b*, R3*c*, and R3*d*.

In another alternate example embodiment, reinforcement areas R3*a*, R3*b*, R3*c*, and R3*d* include more reinforcing fibers 2140 than reinforcement areas R2*a*, R2*b*, R2*c*, and R2*d*. In this other alternate example, reinforcement areas R2*a*, R2*b*, R2*c*, and R2*d* include more reinforcing fibers 2140 than reinforcement area R1.

In this illustrated example embodiment, the concrete substrate reinforcement apparatus 2100 is configured to provide non-uniform reinforcement levels of the concrete slab 2050. For example, reinforcement areas having greater amounts of desired reinforcement levels include both longitudinally and transversely extending dowels 2120 and 2130, and reinforcing fibers 2140. Reinforcement areas having intermediate amounts of desired reinforcement levels include either longitudinally extending dowels 2120 or transversely extending dowels 2130, and reinforcing fibers 2140. Reinforcement areas having the lowest amounts of desired reinforcement levels include only reinforcing fibers 2140. In other words, the concrete substrate reinforcement apparatus 2110 is configured to provide a greater reinforcement level in certain areas of the concrete slab 2050 and a lesser reinforcement level in certain other areas of the concrete slab 2050.

In this illustrated example, dowels and reinforcing fibers in reinforcement area R1 of the concrete slab 2050 provide a greater reinforcement level than the reinforcement level provided by dowels and reinforcing fibers in reinforcement areas R2*a*, R2*b*, R2*c*, and R2*d* of the concrete slab 2050. Dowels and reinforcing fibers in reinforcement areas R2*a*, R2*b*, R2*c*, and R2*d* of the concrete slab 2050 provide a greater reinforcement level than the reinforcement level provided by the reinforcing fibers in reinforcement areas R3*a*, R3*b*, R3*c*, and R3*d* of the concrete slab 2050.

As a result, reinforcement area R1 of the concrete substrate 2050 has the highest reinforcement level using reinforcing fibers 2140 disposed the concrete slab 2050 and longitudinally and transversely extending dowels 2120 and 2130 extending through at least a portion of the concrete slab 2050. Reinforcement areas R2*a* and R2*c* of the concrete substrate 2050 have the intermediate reinforcement level using reinforcing fibers 2140 disposed within the concrete slab 2050 and transversely extending dowels 2130 extending through at least a portion of the concrete slab 2050. Reinforcement areas R2*b* and R2*d* of the concrete substrate 2050 have the intermediate reinforcement level using reinforcing fibers 2140 disposed within the concrete slab 2050 and longitudinally extending dowels 2120 extending through at least a portion of the concrete slab 2050. Reinforcement areas R3*a*, R3*b*, R3*c*, and R3*d* have the lowest reinforcement level using only reinforcing fibers 2140 disposed within the concrete slab 2050.

Figure 11:
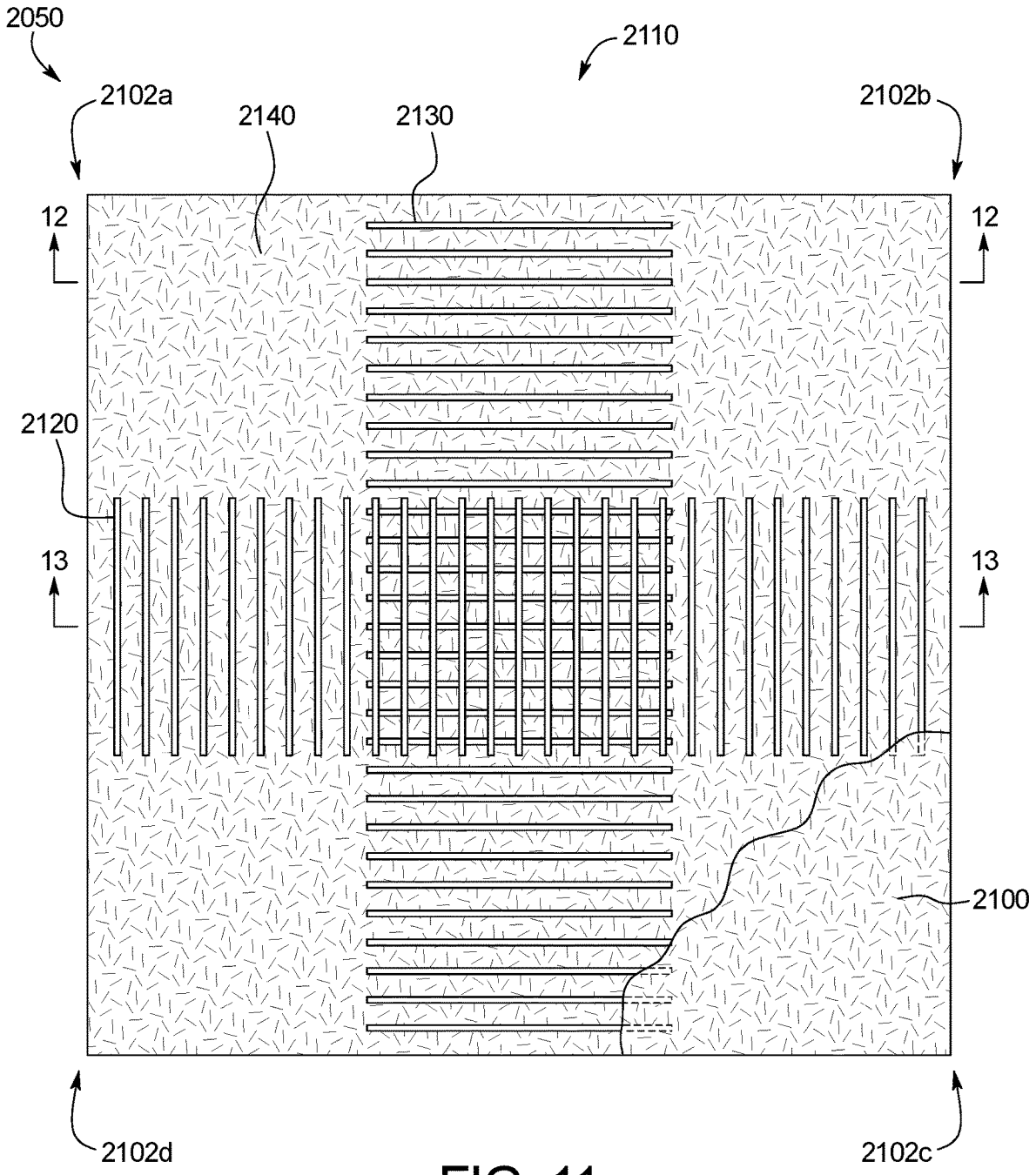
FIG. 11 is a fragmentary top view of another example embodiment of a functionally reinforced concrete slab of the present disclosure showing fibers disposed in the concrete, showing longitudinally extending reinforcing dowels extending through a portion of the concrete slab, and showing transversely extending reinforcing dowels extending through a portion the concrete slab.
Figure 11A:
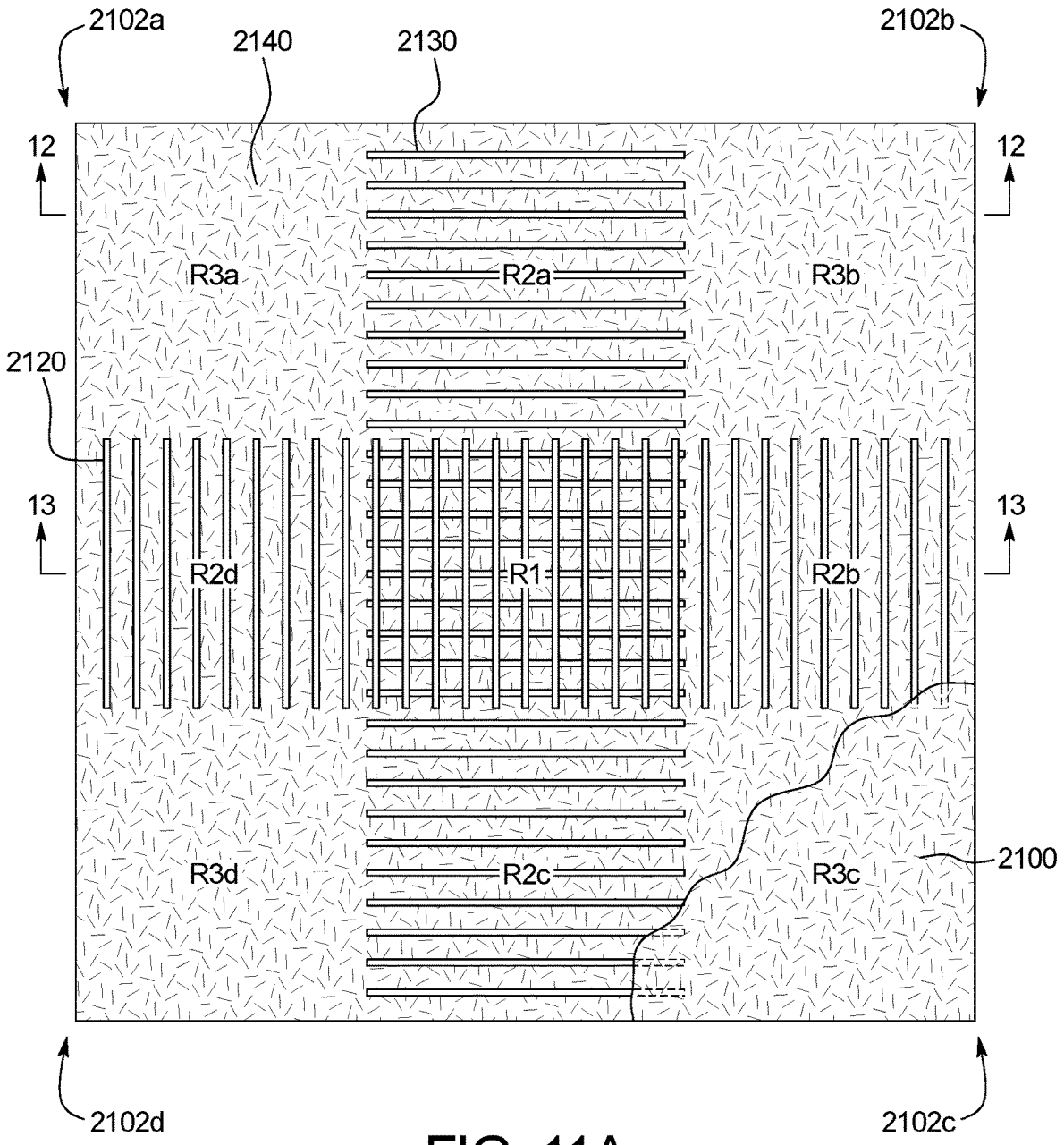
FIG. 11A is a fragmentary top view of the functionally reinforced concrete slab of FIG. 11, showing the labeled different reinforcing areas of the concrete slab.
Figure 12:
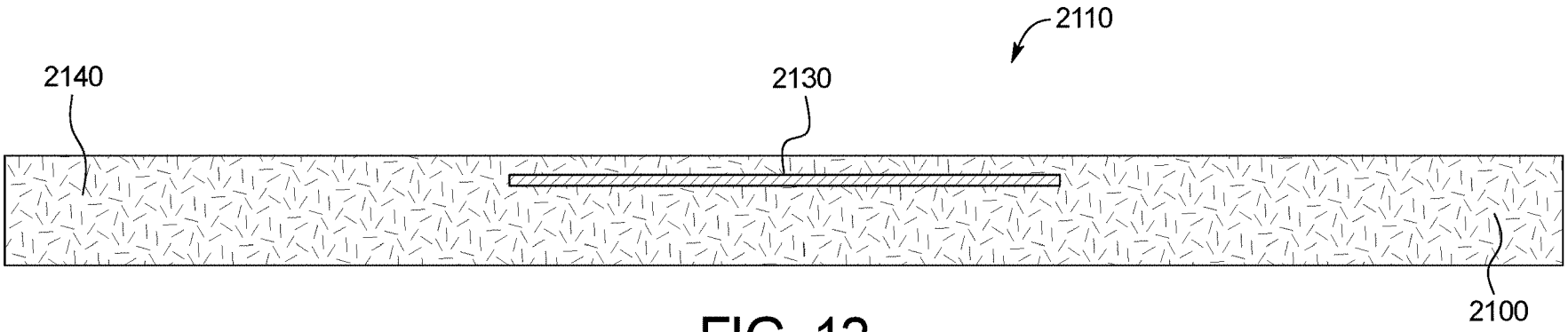
FIG. 12 is an enlarged transverse cross-sectional view taken substantially along line 12-12 of the reinforced concrete slab of FIG. 11, showing a transversely extending reinforcing dowel extending through a portion of the concrete slab.

FIGS. 11, 11A, and 12 show a transverse cross-sectional view of the concrete substrate reinforcement apparatus 2110 taken substantially along line 12-12 and through different reinforcement areas of the concrete slab 2050. In this illustrated example, the concrete substrate reinforcement apparatus 2110 includes reinforcing fibers 2140 disposed in reinforcement area R2*a* of the concrete slab 2050 and a transversely extending dowel 2130 extending through reinforcement area R2*a* of the concrete slab 2050. This illustrated example further includes, only reinforcing fibers 2140 disposed in reinforcing areas R3*a* and R3*b* of the concrete slab 2050. In this illustrated example, the reinforcing fibers 2140 and the transversely extending dowel 2130 in reinforcement area R2*a* of the concrete slab 2050 provide a greater reinforcement level than the reinforcing fibers 2140 in reinforcement areas R3*a* and R3*b* of the concrete slab 2050.

Figure 13:
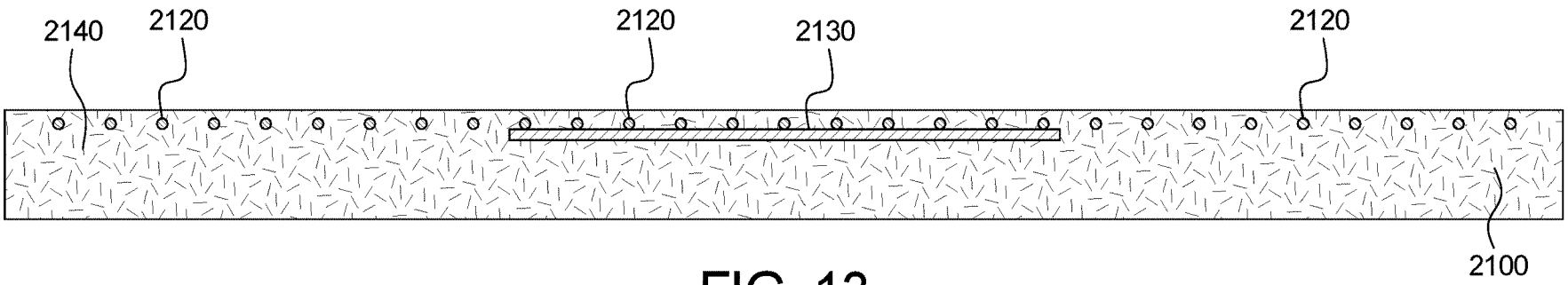
FIG. 13 is an enlarged transverse cross-sectional view taken substantially along line 13-13 of the reinforced concrete slab of FIG. 11, showing longitudinally and transversely extending reinforcing dowels extending through a portion of the concrete slab.

FIGS. 11, 11A, and 13 show a transverse cross-sectional view of the concrete substrate reinforcement apparatus 2110 taken substantially along line 13-13 and through different reinforcement areas of the concrete slab 2050. In this illustrated example, the concrete substrate reinforcement apparatus 2110 includes reinforcing fibers 2140 disposed in reinforcement area R1 of the concrete slab 2050, a transversely extending dowel 2130 extending through reinforcement area R1 of the concrete slab 2050, and a plurality of longitudinally extending dowels 2120 extending through reinforcement area R1 of the concrete slab 2050. In this illustrated example embodiment, the plurality of longitudinally extending dowels 2120 overlap with the transversely extending dowels 2130 to form the overlapping grid pattern of the concrete substrate reinforcement apparatus 2110. This illustrated example further includes, reinforcing fibers 2140 disposed in reinforcing areas R2*b* and R2*d* of the concrete slab 2050, and longitudinally extending dowels 2120 extending through reinforcing areas R2*a* and R2*b* of the concrete slab 2050.

FIGS. 14, 14A, 15, and 16 illustrate another example embodiment of a functionally reinforced concrete slab of the present disclosure indicated by numeral 3050 (and sometimes referred to herein as "the concrete slab" for brevity). This example illustrated functionally reinforced concrete slab 3050 includes: (1) a concrete substrate 3100; and (2) a concrete substrate reinforcement apparatus 3110 supported within the concrete substrate 3100.

In this illustrated example embodiment, the concrete substrate 3100 has a generally square shape including a plurality of substrate free-edges 3102*a*, 3102*b*, 3102*c*, and 3102*d* defined at the corners and along the perimeter of the concrete slab 3050. It will be appreciated that the concrete substrate 3100 may have a different shape and the plurality of substrate free-edges may be defined along the corners and/or edges of that different shape.

In this illustrated example embodiment, the concrete substrate reinforcement apparatus 3110 has a plurality of reinforcement areas R1, R2*a*, R2*b*, R2*c*, R2*d*, R3*a*, R3*b*, R3*c*, and R3*d* in the concrete slab 3050.

Reinforcement area R1 provides a first reinforcement level for the concrete slab 3050. Reinforcement areas R2*a*, R2*b*, R2*c*, and R2*d* are substantially similar to each other and provide a second reinforcement level for the concrete slab 3050. Reinforcement areas R3*a*, R3*b*, R3*c*, and R3*d* are substantially similar to each other and provide a third reinforcement level for the concrete slab 3050.

In this illustrated example embodiment, reinforcement levels of the concrete slab 3050 have the following relationship: first reinforcement level>second reinforcement level>third reinforcement level. As such, the reinforcement levels of the concrete slab 3050 are greater in an interior area of the concrete slab 3050 and the reinforcement levels are less in an exterior area of the concrete slab 3050. In this illustrated example embodiment, the reinforcement levels of the concrete slab 3050 are greater in a central area of the concrete slab 3050 and the reinforcement levels of the concrete slab 3050 are less in an outer area surrounding the central area of the concrete slab 3050.

Thus, in this illustrated example embodiment, the concrete slab 3050 has a plurality of different substrate areas that have different reinforcement levels corresponding to the respective reinforcement levels R1, R2*a*, R2*b*, R2*c*, R2*d*, R3*a*, R3*b*, R3*c*, and R3*d* of the concrete substrate reinforcement apparatus 3110.

In this illustrated example embodiment, the different reinforcement levels of the concrete slab 3050 are configured to keep cracks tight during shifting, settling, expansion, contraction, and/or other such movement of the concrete slab 3050. In this illustrated example, the desired reinforcement levels are based on the amount of reinforcement needed to keep the cracks tight. As such, certain areas of the concrete slab 2050 have different desired reinforcement levels (e.g., greater or lesser) than certain other areas of the concrete slab 3050.

In this illustrated example embodiment, the concrete reinforcement apparatus 3110 includes: (1) a plurality of longitudinally extending dowels 3120 supported within the concrete substrate 3100 and extending along a length of the concrete substrate 3100; and (2) a plurality of transversely extending dowels 3130 supported within the concrete substrate 3100 and extending along a width of the concrete substrate 3100.

In this illustrated example embodiment, the longitudinally and transversely extending dowels 3120 and 3130 are formed from steel rods. However, it should be appreciated that the dowels can be made from other suitable materials.

In this illustrated example embodiment, the longitudinally extending dowels 3120 have substantially the same length and diameter as the transversely extending dowels 3130.

In this illustrated example embodiment, the plurality of longitudinally and transversely extending dowels 3120 and 3130 are positioned and orientated within the concrete substrate 3100 to provide a pattern of the concrete reinforcement apparatus 3110. For example, the plurality of transversely extending dowels 3130 are positioned in a repeating or arrayed pattern such that adjacent transversely extending dowels 3130 are spaced apart from one another along the width of the concrete substrate 3100. The plurality of longitudinally extending dowels 3120 are orientated perpendicular to the plurality of transversely extending dowels 3130. In this illustrated example, the plurality of longitudinally extending dowels 3120 are positioned in a repeating or arrayed pattern such that adjacent longitudinally extending dowels 3120 are spaced apart from one another along the length of the concrete substrate 3100.

In this illustrated example embodiment, certain of the longitudinally extending dowels 3120 are placed on top of and suitably connected to the plurality of transversely extending dowels 3130 to form an overlapping grid pattern including longitudinally extending dowels and transversely extending dowels 3130 of the concrete reinforcement apparatus 3110.

In this illustrated example embodiment, the concrete substrate reinforcement apparatus 3100 is configured to provide non-uniform reinforcement levels of the concrete slab 3050. For example, reinforcement areas having greater amounts of desired reinforcement levels include both longitudinally and transversely extending dowels 3120 and 3130. Reinforcement areas having intermediate amounts of desired reinforcement levels include either longitudinally extending dowels 3120 or transversely extending dowels 3130. Reinforcement areas having the lowest amounts of desired reinforcement levels include unreinforced concrete. In other words, the concrete substrate reinforcement apparatus 3110 is configured to provide a greater reinforcement level in certain areas of the concrete slab 3050 and a lesser reinforcement level in certain other areas of the concrete slab 3050.

In this illustrated example, dowels in reinforcement area R1 of the concrete slab 3050 provide a greater reinforcement level than the reinforcement level provided by dowels in reinforcement areas R2*a*, R2*b*, R2*c*, and R2*d* of the concrete slab 3050. Dowels in reinforcement areas R2*a*, R2*b*, R2*c*, and R2*d* of the concrete slab 3050 provide a greater reinforcement level than the unreinforced concrete in reinforcement areas R3*a*, R3*b*, R3*c*, and R3*d*.

As a result, reinforcement area R1 of the concrete substrate 3050 has the highest reinforcement level using longitudinally and transversely extending dowels 3120 and 3130 extending through at least a portion of the concrete slab 3050. Reinforcement areas R2*a* and R2*c* of the concrete substrate 3050 have the intermediate reinforcement level using transversely extending dowels 3130 extending through at least a portion of the concrete slab 3050. Reinforcement areas R2*b* and R2*d* of the concrete substrate 3050 have the intermediate reinforcement level using longitudinally extending dowels 3120 extending through at least a portion of the concrete slab 3050. Reinforcement areas R3*a*, R3*b*, R3*c*, and R3*d* have the lowest reinforcement level using unreinforced concrete of the concrete slab 3050.

Figure 14:
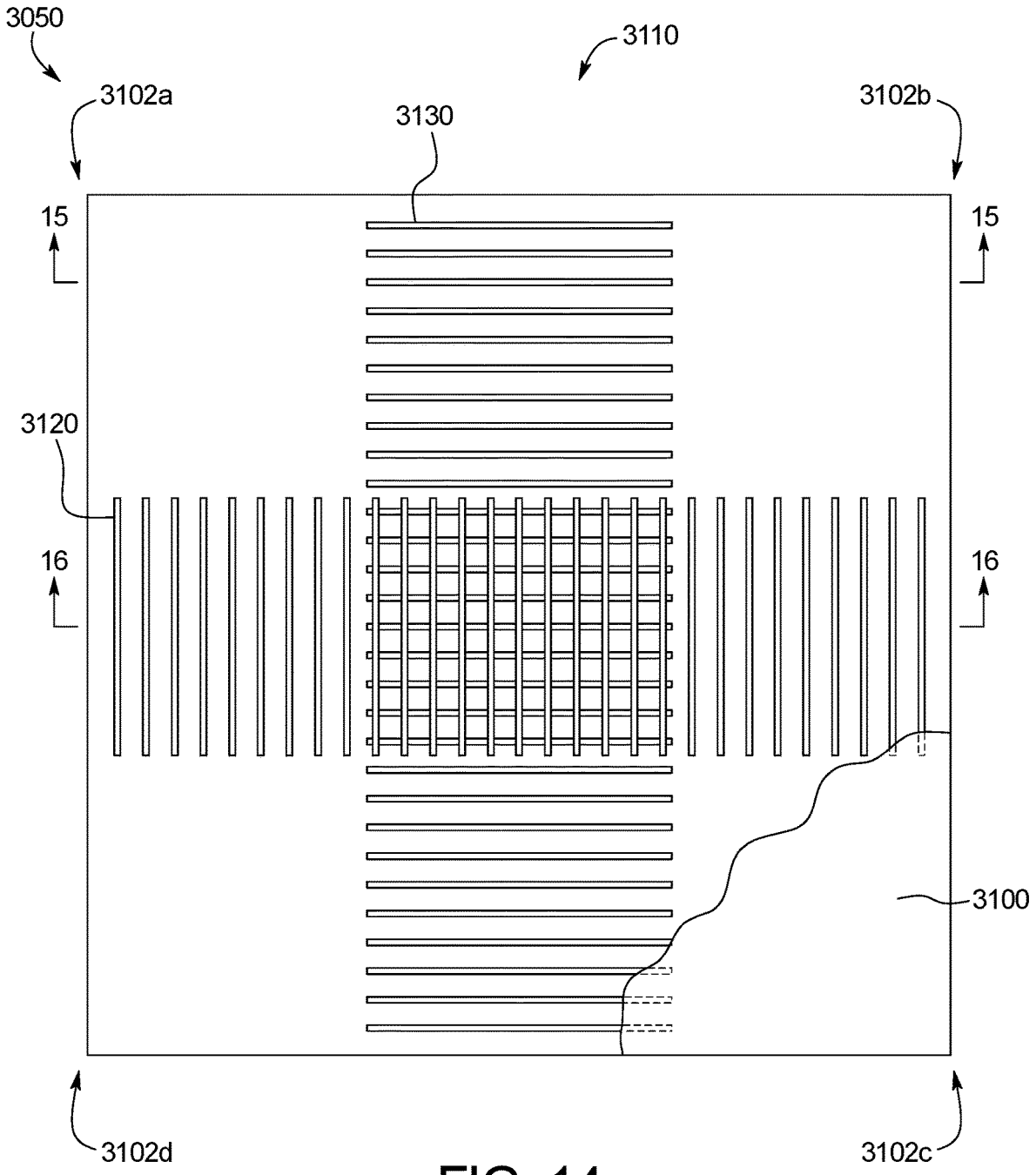
FIG. 14 is a fragmentary top view of another example embodiment of a functionally reinforced concrete slab of the present disclosure showing longitudinally extending reinforcing dowels extending through a portion of the concrete slab, and showing transversely extending reinforcing dowels extending through a portion the concrete slab.
Figure 14A:
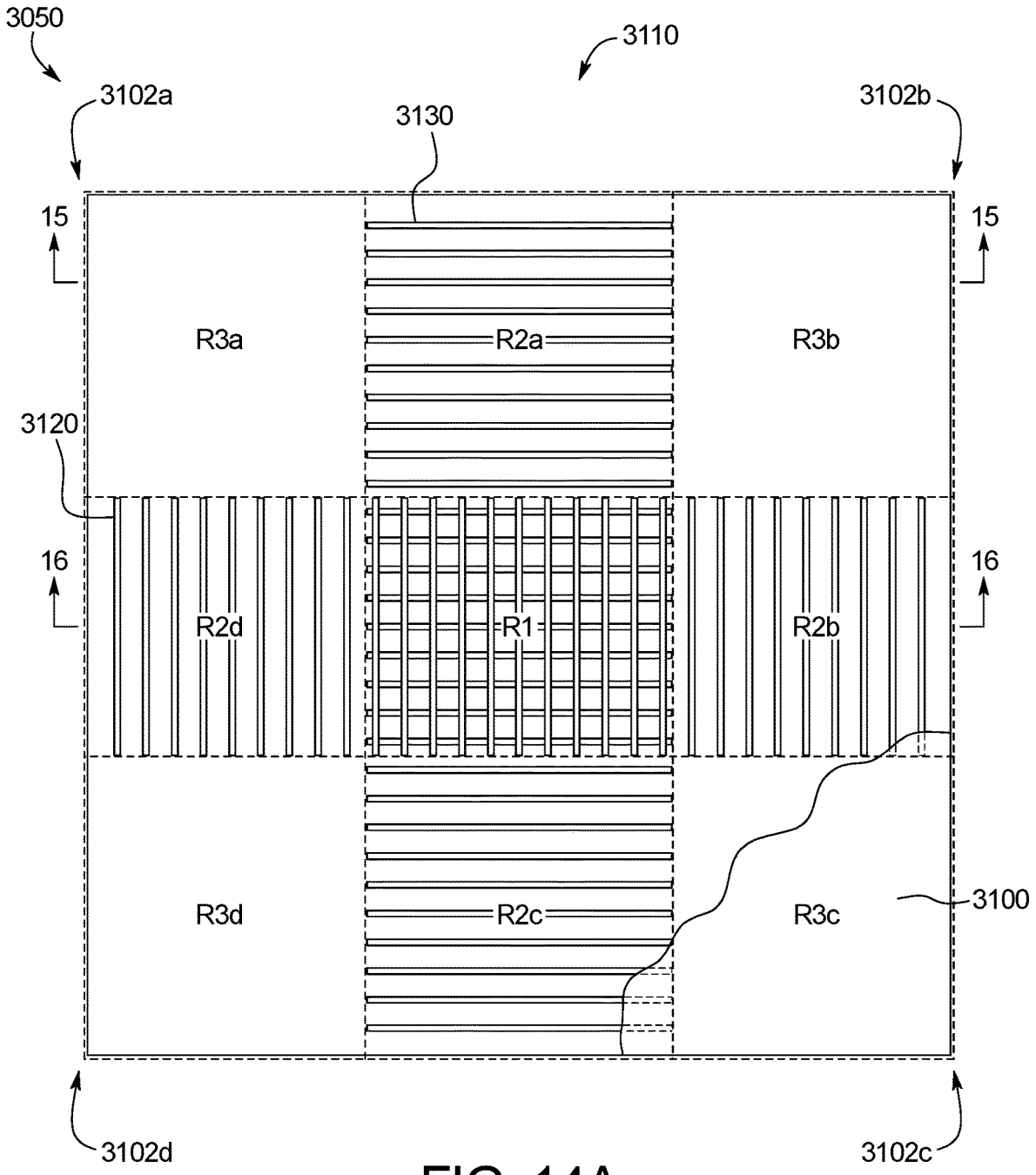
FIG. 14A is a fragmentary top view of the functionally reinforced concrete slab of FIG. 14, showing reinforcing areas associated with different areas of the concrete slab.
Figure 15:
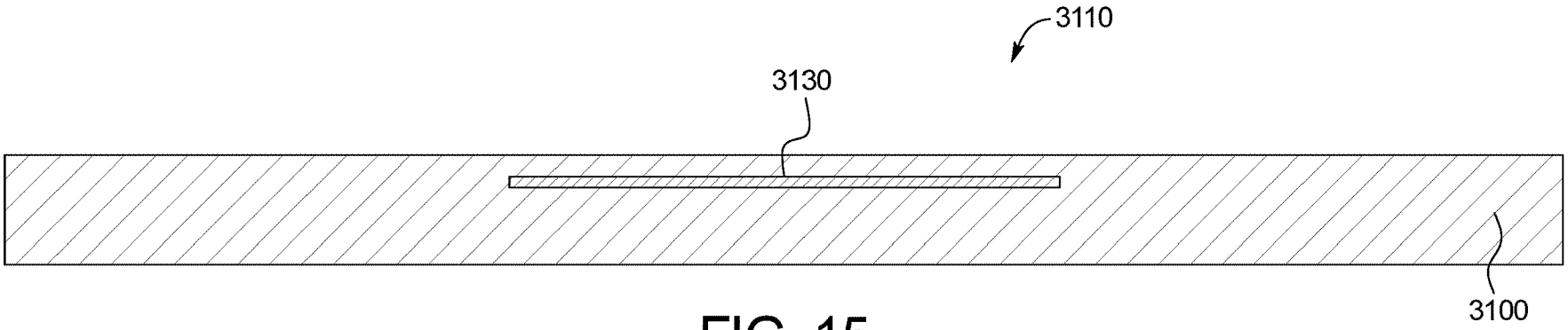
FIG. 15 is an enlarged transverse cross-sectional view taken substantially along line 15-15 of the reinforced concrete slab of FIG. 14, showing a transversely extending reinforcing dowel extending through a portion of the concrete slab.

FIGS. 14, 14A, and 15 show a transverse cross-sectional view of the concrete substrate reinforcement apparatus 3110 taken substantially along line 15-15 and through different reinforcement areas of the concrete slab 3050. In this illustrated example, the concrete substrate reinforcement apparatus 3110 includes a transversely extending dowel 3130 extending through reinforcement area R2*a* of the concrete slab 3050. This illustrated example further includes, portions of unreinforced concrete in reinforcing areas R3*a* and R3*b* of the concrete slab 3050. As such, the transversely extending dowel 3130 extending through reinforcement area R2*a* of the concrete slab 3050 provides a greater reinforcement level than the unreinforced concrete in reinforcing areas R3*a* and R3*b* of the concrete slab 3050.

Figure 16:
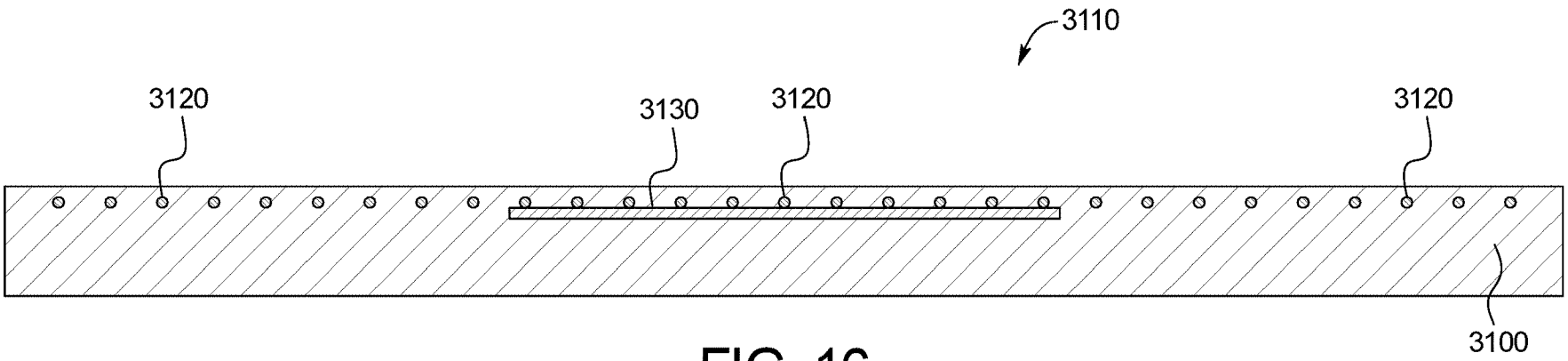
FIG. 16 is an enlarged transverse cross-sectional view taken substantially along line 16-16 of the reinforced concrete slab of FIG. 14, showing longitudinally and transversely extending reinforcing dowels extending through a portion of the concrete slab.

FIGS. 14, 14A, and 16 show a transverse cross-sectional view of the concrete substrate reinforcement apparatus 3110 taken substantially along line 16-16 and through different reinforcement areas of the concrete slab 3050. In this illustrated example, the concrete substrate reinforcement apparatus 3110 includes a transversely extending dowel 2130 and a plurality of longitudinally extending dowels 3120 extending through reinforcement area R1 of the concrete slab 3050. The plurality of longitudinally extending dowels 3120 overlap with the transversely extending dowels 2130 to form the overlapping grid pattern of the concrete substrate reinforcement apparatus 3110. This illustrated example further includes longitudinally extending bars 3120 extending through reinforcing areas R2*a* and R2*b* of the concrete slab 3050. In this illustrated example, the transversely extending dowel 3130 and the plurality of longitudinally extending dowels 3120 extending through the concrete substrate 3100 of reinforcement area R1 provide a greater reinforcement level than the longitudinally extending dowels 3120 extending through reinforcement areas R2*b* and R2*d* of the concrete slab 3050.

Example Method of Manufacture of a Functionally Reinforced Concrete Slab

One example embodiment of a method of manufacturing a functionally reinforced concrete slab having non-uniform reinforcement levels includes forming a concrete substrate having a concrete substrate reinforcement apparatus. More specifically, the concrete substrate reinforcement apparatus is employed in a casting and/or paving process for forming the functionally reinforced concrete slab that is supported on the ground or other such supporting surface. The concrete substrate reinforcement apparatus is configured to provide non-uniform reinforcement levels of the concrete slab.

In various such example embodiments, the method of manufacturing the functionally reinforced concrete slab includes: (1) positioning a concrete substrate reinforcement apparatus a desired height above the ground or other such supporting surface (using suitable supporting members); and (2) pouring a wet layer of concrete on the ground or other such supporting surface to form a concrete substrate. The concrete layer encloses the concrete substrate reinforcement apparatus in the concrete layer.

In various embodiments, positioning the concrete substrate reinforcement apparatus includes: (a) positioning a plurality of longitudinally extending dowels spaced as necessary such that the dowels span a desired dimension (e.g., desired length) of the concrete substrate; and (b) positioning a plurality of transversely extending dowels spaced as necessary such that the dowels span a desired dimension (e.g., desired width) of the concrete substrate.

In one such example, the plurality of longitudinally and transversely extending dowels are configured to include decreasing diameters from the center of the dowel to the end of the dowel. For example each longitudinally and transversely extending dowel includes: (a) a first dowel portion including a first diameter having the largest dimensions; (b) two second dowel portions including a different second diameter having smaller, intermediate dimensions; and (c) two third dowel portions including a different third diameter having the smallest dimensions. The dimeter dimensions decrease along the span of the longitudinally and transversely extending dowels from the first dowel portion in the center of the dowel out to the third dowel portions at the ends of the dowel. As such, positioning the concrete substrate reinforcement apparatus may include positioning the longitudinally and transversely extending dowels such that the largest diameter dimensions are in the center portion of the concrete substrate.

In another such example embodiment, the plurality of longitudinally and transversely extending dowels are configured to include different lengths for certain of the dowels. For example, the longitudinally and transversely extending dowels include: (a) a first dowel having a first length; and (b) a second dowel having a second length different from the first length of the first longitudinal dowel. The first length of each first dowel is shorter than the second length of each second dowel. In this example, the longitudinally and transversely extending dowels include substantially similar dimensions (e.g., length and diameter) for the first and second dowels.

In this example embodiment, positioning the longitudinal and transverse dowels include: (a) positioning the first dowels such that the dowels do not extend through portions of the concrete substrate adjacent to the substrate free-edges or corners; and (b) positioning the second dowels such that the dowels extend substantially from one edge of the concrete substrate to the opposite edge of the concrete substrate. As such, positioning the concrete substrate reinforcement apparatus may include positioning the shorter, first dowels such that these dowels do not extend through portions of the concrete substrate adjacent to the substrate free-edges or corners, and positioning the longer, second dowels such that these dowels extend substantially from one edge of the concrete substrate to the opposite edge of the concrete substrate.

In another such example embodiment, the longitudinally and extending dowels have substantially similar dimensions (e.g., length and diameter). In this example, positioning the longitudinal and transverse dowels includes positioning the longitudinal and transverse dowels such that the dowels do not extend through portions of the concrete substrate adjacent to the substrate free-edges or corners. As such, positioning the concrete substrate reinforcement apparatus may include positioning the longitudinally and transversely extending dowels such the dowels extend through portions of the concrete substrate adjacent to the middle of a span between the substrate free-edges or corners. The longitudinal and transverse dowels do not extend through portions of the concrete substrate adjacent to the substrate free-edges or corners.

In various example embodiments, pouring the wet layer of concrete of the concrete substrate includes disposing or otherwise mixing reinforcing fibers in the layer of concrete. The reinforcing fibers are distributed within the concrete substrate such that the reinforcing fibers extend substantially through the entire length and width of the concrete substrate. For example, the reinforcing fibers are distributed in a substantially uniform amount within the concrete substrate. Alternatively, the reinforcing fibers may be distributed in a non-uniform amount such that there is a greater amount of reinforcing fibers in certain areas of the concrete substrate and a lesser amount of reinforcing fibers in certain other areas of the concrete substrate.

In various example embodiments, the concrete substrate reinforcement apparatus is supported on the ground or other such supporting surface by support members to position the dowels of the concrete substrate reinforcement apparatus at a desired location above the ground or support surface. In various such embodiments, pouring the concrete substrate reinforcement apparatus includes positioning the dowels of the concrete substrate reinforcement apparatus on the supporting members prior to pouring the wet layer of concrete of the concrete substrate. Pouring the wet layer of concrete of the concrete substrate on the ground or other supporting surface includes pouring an amount of wet concrete to form a desired thickness of the concrete substrate. The wet layer of concrete of the concrete substrate encloses the concrete substrate reinforcement apparatus within the concrete substrate thickness to provide the desired reinforcement levels of the concrete substrate.

In various other embodiments, pouring the wet layer of concrete of the concrete substrate on the ground or other supporting surface includes: (a) pouring a first layer of wet concrete on the ground or other such support surface; (b) pouring the concrete substrate reinforcement apparatus on a top surface of the first layer of wet concrete; and (c) pouring a second layer of wet concrete on top of the first layer of concrete and the plurality of longitudinally and transversely extending dowels. In this example, the concrete substrate reinforcement apparatus is positioned between the first and second layers of concrete that form the concrete substrate.

It will be understood that modifications and variations may be effected without departing from the scope of the novel concepts of the present invention, and it is understood that this application is to be limited only by the scope of the claims.

The invention claimed is:

1. A functionally reinforced concrete slab comprising:

a concrete substrate; and a concrete substrate reinforcement apparatus in the concrete substrate, wherein the concrete substrate reinforcement apparatus is configured and positioned in the concrete substrate to provide non-uniform reinforcement of the concrete substrate, wherein the concrete substrate reinforcement apparatus includes:

a plurality of longitudinally extending dowels that each include: (a) a first longitudinal dowel portion having a first diameter; (b) a second longitudinal dowel portion connected to and extending from one end of the first longitudinal dowel portion, the second longitudinal dowel portion having a second diameter that is smaller than the first diameter of the first longitudinal dowel portion; (c) a third longitudinal dowel portion connected to and extending from a second end of the first longitudinal dowel portion, the third longitudinal dowel portion having a third diameter smaller than the first diameter of the first longitudinal dowel portion, (d) a fourth longitudinal dowel portion connected to and extending from one end of the second longitudinal dowel portion, the fourth longitudinal dowel portion having a fourth diameter smaller than the second diameter of the second longitudinal dowel portion; and (e) a fifth longitudinal dowel portion connected to and extending from one end of the third longitudinal dowel portion, the fifth longitudinal dowel portion having a fifth diameter smaller than the third diameter of the third longitudinal dowel portion; and a plurality of transversely extending dowels that each include: (a) a first transverse dowel portion having a first diameter; (b) a second transverse dowel portion connected to and extending from one end of the first transverse dowel portion, the second transverse dowel portion having a second diameter that is smaller than the first diameter of the first transverse dowel portion; (c) a third transverse dowel portion connected to and extending from a second end of the first transverse dowel portion, the third transverse dowel portion having a third diameter smaller than the first diameter of the first transverse dowel portion, (d) a fourth transverse dowel portion connected to and extending from one end of the second transverse dowel portion, the fourth transverse dowel portion having a fourth diameter smaller than the second diameter of the second longitudinal dowel portion; and (e) a fifth transverse dowel portion connected to and extending from one end of the third transverse dowel portion, the fifth transverse dowel portion having a fifth diameter smaller than the third diameter of the third transverse dowel portion.

2. The functionally reinforced concrete slab of claim 1, wherein the plurality of longitudinally extending dowels and the plurality of longitudinally extending dowels of the concrete substrate reinforcement apparatus are configured and positioned in the concrete substrate such that the concrete slab includes five different reinforcement levels.

3. The functionally reinforced concrete slab of claim 1, wherein a first substrate area of the concrete substrate includes the first longitudinal dowel portions of a plurality of the longitudinally extending dowels and the first transverse dowel portions of a plurality of the transversely extending dowels.

4. The functionally reinforced concrete slab of claim 3, wherein the first substrate area is a central area and a second substrate area is an outer area at least partially surrounding the central area.

5. The functionally reinforced concrete slab of claim 4, wherein a first part of the second substrate area includes the first longitudinal dowel portions of a plurality of the longitudinally extending dowels and the second transverse dowel portions of a plurality of the transversely extending dowels.

6. The functionally reinforced concrete slab of claim 5, wherein a second part of the second substrate area includes the second longitudinal dowel portions of a plurality of the longitudinally extending dowels and the first transverse dowel portions of a plurality of the transversely extending dowels.

7. The functionally reinforced concrete slab of claim 6, wherein the concrete substrate is partially reinforced by fibers.

8. The functionally reinforced concrete slab of claim 6, which includes a third substrate area that includes the fourth longitudinal dowel portions of a plurality of the longitudinally extending dowels and the third transverse dowel portions of a plurality of the transversely extending dowels.

9. The functionally reinforced concrete slab of claim 8, which includes a fourth substrate area that includes the fifth longitudinal dowel portions of a plurality of the longitudinally extending dowels and the fifth transverse dowel portions of a plurality of the transversely extending dowels.

10. The functionally reinforced concrete slab of claim 1, wherein the concrete substrate is partially reinforced by fibers.

11. A functionally reinforced concrete slab comprising:

a central substrate area having a plurality of first longitudinally extending dowels and a plurality of first transversely extending dowels that overlap with the plurality of first longitudinally extending dowels in the central substrate area, the plurality of first longitudinally extending dowels and the plurality of first transversely extending dowels providing a first reinforcement level for the central substrate area;

a plurality of first outer substrate areas each having a plurality of second longitudinally extending dowels but not any transversely extending dowels in that first outer substrate area, wherein the plurality of second longitudinally extending dowels in each of the plurality of first outer substrate areas provides a second reinforcement level for that first outer substrate area that is different than the first reinforcement level;

a plurality of second outer substrate areas each having a plurality of second transversely extending dowels but not any longitudinally transversely extending dowels in that second outer substrate area, wherein the plurality of second transversely extending dowels in each of the plurality of second outer substrate areas provides a third reinforcement level for that second outer substrate area that is different than the first reinforcement level;

a plurality of corner outer substrate areas each having no reinforcement apparatus in the form of any dowels; and wherein the central substrate area, the plurality of first outer substrate areas, the plurality of second outer substrate areas, and the plurality of corner outer substrate areas are all partially reinforced by fibers.

12. A functionally reinforced concrete slab comprising:

a first substrate area having a first reinforcement level provided by longitudinally and transversely extending dowel portions each having a first diameter;

a plurality of second substrate areas each having a second reinforcement level that is different than the first reinforcement level and that is provided by longitudinally and transversely extending dowel portions each having a second diameter that is smaller than the first diameter; and a plurality of third substrate areas each having a third reinforcement level that is different than the first reinforcement level, that is different than the second reinforcement level, and this is provided by longitudinally and transversely extending dowel portions each having a third diameter that is smaller than the first diameter and that is smaller than the second diameter, wherein the first substrate area is a central area, the plurality of second substrate areas are a plurality of intermediate areas surrounding the central area, and the plurality of third substrate areas are a plurality of outer areas relative to the intermediate areas and the central area.

* * * * *